US008201487B2

(12) United States Patent
Dueck et al.

(10) Patent No.: US 8,201,487 B2
(45) Date of Patent: Jun. 19, 2012

(54) BLANK FIRING ADAPTER FOR FIREARM

(75) Inventors: Barry W. Dueck, Corona, CA (US); Karl Honigmann, Anaheim Hills, CA (US)

(73) Assignee: SureFire, LLC, Fountain Valley, CA (US)

( * ) Notice: Subject to any disclaimer, the term of this patent is extended or adjusted under 35 U.S.C. 154(b) by 232 days.

(21) Appl. No.: 12/774,500

(22) Filed: May 5, 2010

(65) Prior Publication Data

US 2010/0313457 A1 Dec. 16, 2010

Related U.S. Application Data

(63) Continuation-in-part of application No. 12/482,664, filed on Jun. 11, 2009, now Pat. No. 8,091,462.

(51) Int. Cl.
*F41A 21/26* (2006.01)

(52) U.S. Cl. ..... 89/14.05; 89/14.5; 42/96

(58) Field of Classification Search ..... 89/14.05, 89/14.5, 29, 30, 31; 42/1.01–1.05, 96
See application file for complete search history.

(56) References Cited

U.S. PATENT DOCUMENTS

| | | | | |
|---|---|---|---|---|
| 615,279 | A | | 12/1898 | Jones |
| 720,688 | A | | 2/1903 | Hagedorn |
| 1,394,490 | A | | 10/1921 | Giles |
| 2,124,075 | A | | 7/1938 | Moore |
| 2,222,334 | A | | 11/1940 | Brouwer |
| 2,267,252 | A | | 12/1941 | Pitsch |
| 2,412,409 | A | | 12/1946 | Martin |
| 2,628,854 | A | | 2/1953 | Gardner |
| 2,809,560 | A | | 10/1957 | Matson et al. |
| 2,848,814 | A | | 8/1958 | Walton |
| 2,859,058 | A | | 11/1958 | Traugott |
| 3,029,540 | A | | 4/1962 | Pachmayr |
| 3,123,929 | A | | 3/1964 | Pachmayr et al. |
| 3,163,953 | A | | 1/1965 | Bridge, Sr. |
| 3,257,108 | A | | 6/1966 | Pachmayr et al. |
| 3,259,407 | A | | 7/1966 | Welt |
| 3,440,924 | A | | 4/1969 | Sawyer |
| 3,664,263 | A | * | 5/1972 | Driscoll ..... 102/485 |
| 3,698,747 | A | | 10/1972 | Wing et al. |
| 3,766,822 | A | | 10/1973 | Sophinos |
| 4,134,175 | A | | 1/1979 | Contoyanis |
| 5,155,915 | A | | 10/1992 | Repa |
| 5,259,690 | A | | 11/1993 | Legge |
| 5,325,758 | A | * | 7/1994 | Compton et al. ..... 89/14.5 |
| 5,375,361 | A | | 12/1994 | Rustick |

(Continued)

FOREIGN PATENT DOCUMENTS

DE 103 05 644 B3 5/2004

(Continued)

*Primary Examiner* — Bret Hayes
*Assistant Examiner* — Joshua Freeman
(74) *Attorney, Agent, or Firm* — Haynes and Boone, LLP

(57) ABSTRACT

Various techniques are provided for firing blanks from firearms. In one example, a blank firing adapter includes a mount assembly operatively configured to be attached to a muzzle of a firearm. The blank firing adapter also includes a main body having an interior chamber. The blank firing adapter also includes an escape port positioned longitudinally forward of the interior chamber and not in communication therewith. The blank firing adapter also includes a barrier interposed between the escape port and the interior chamber. The blank firing adapter also includes a projectile receiving area positioned longitudinally forward of the escape port and configured to slow down a projectile from the muzzle therethrough.

13 Claims, 37 Drawing Sheets

U.S. PATENT DOCUMENTS

| | | | | |
|---|---|---|---|---|
| 5,377,438 | A | 1/1995 | Sheinfeld et al. | |
| 5,513,554 | A | 5/1996 | Paulsson | |
| 5,559,302 | A | 9/1996 | Latka | |
| 5,685,102 | A | 11/1997 | Latka | |
| 5,983,772 | A * | 11/1999 | Reynolds et al. | 89/29 |
| 6,026,728 | A | 2/2000 | Guhring et al. | |
| 6,176,032 | B1 * | 1/2001 | Cohen et al. | 42/96 |
| 6,289,623 | B1 | 9/2001 | Cohen et al. | |
| 6,889,593 | B2 * | 5/2005 | Guhring et al. | 89/14.5 |
| 6,948,415 | B2 | 9/2005 | Matthews et al. | |
| 7,290,475 | B2 * | 11/2007 | Fluhr | 89/14.5 |
| 7,321,175 | B2 | 1/2008 | Culpi et al. | |
| 7,594,464 | B2 | 9/2009 | Dueck | |
| 7,661,349 | B1 | 2/2010 | Brittingham | |
| 7,676,976 | B2 | 3/2010 | Dueck et al. | |
| 7,677,150 | B2 | 3/2010 | Dater et al. | |
| 8,096,073 | B2 * | 1/2012 | Vielbig | 42/1.01 |
| 2001/0049996 | A1 | 12/2001 | Fluhr | |
| 2003/0019352 | A1 | 1/2003 | Mika | |
| 2005/0115394 | A1 | 6/2005 | Matthews et al. | |
| 2006/0060076 | A1 | 3/2006 | Dueck et al. | |
| 2006/0243125 | A1 * | 11/2006 | La France | 89/31 |
| 2010/0313457 | A1 * | 12/2010 | Dueck et al. | 42/1.01 |
| 2010/0313743 | A1 * | 12/2010 | Dueck et al. | 89/14.05 |
| 2011/0056364 | A1 * | 3/2011 | Kennedy et al. | 89/14.05 |
| 2011/0154711 | A1 * | 6/2011 | Dickerson et al. | 42/107 |
| 2011/0271573 | A1 * | 11/2011 | Vielbig | 42/1.01 |

FOREIGN PATENT DOCUMENTS

| | | | |
|---|---|---|---|
| EP | 0 928 943 | A2 | 7/1999 |
| EP | 1 742 008 | A1 | 1/2007 |

* cited by examiner

BLANK FIRING ADAPTER FOR FIREARM

CROSS-REFERENCE TO RELATED APPLICATIONS

This application is a continuation-in-part application of U.S. patent application Ser. No. 12/482,664 entitled "FIREARM ATTACHMENT LOCKING SYSTEM" filed Jun. 11, 2009 which is incorporated herein by reference in its entirety.

BACKGROUND

1. Field of the Invention

The present invention generally relates to firearm attachments and more particularly to adapters for firing blanks.

2. Related Art

In general, firearms are utilized to fire blanks whereby a blank generally has some form of a charge such as a gunpowder charge without a projectile. In general, when a projectile is passed through the barrel of a firearm, there is a certain amount of back pressure which is utilized in normal operation to operate the action of a rifle such as a semi-asthmatic action and a gas piston system, or in a simple gas system such as in the AR-15. When only a blank is fired, the amount of gas pressure is less without having the accelerating bullet positioned in front of the expanding gas.

There is the risk that an operator of a firearm may actually fire real rounds through a blank firing adapter. Firing a live round can cause an extremely perilous situation for the operator of the firearm, people around the person operating the firearm, and in some cases people down range of the firearm in situations such as on a film set where the firearm is to be used as a prop.

SUMMARY

In one embodiment, a system provides an indicator to the operator of the firearm that a live round is fired so the operator of the firearm will cease firing the live rounds from the firearm. One such indicator is an increase in volume of sound output when a live round is fired. In another embodiment, a system provides a proper routing of live bullets in the safest possible direction.

In another embodiment, a blank firing adapter includes a mount assembly operatively configured to be attached to a muzzle of a firearm. The blank firing adapter also includes a main body having an interior chamber. The blank firing adapter also includes an escape port positioned longitudinally forward of the interior chamber and not in communication therewith. The blank firing adapter also includes a barrier interposed between the escape port and the interior chamber. The blank firing adapter also includes a projectile receiving area positioned longitudinally forward of the escape port and configured to slow down a projectile from the muzzle therethrough.

In another embodiment, an attachment to a firearm is provided to allow the firearm to fire blanks where the attachment increases pressure within a barrel of the firearm to operate the action of the firearm. The attachment includes a main body having an interior chamber in communication with the barrel of the firearm and operatively configured to receive high-pressure gas therein. The attachment also includes an escape port having at least a portion thereof positioned on a central axis of the barrel. The attachment also includes a barrier disposed between the escape port and the interior chamber. The barrier is sufficiently thin to allow a bullet projectile from the barrel to pass through the barrier.

In another embodiment, a method of indicating to a user of a firearm that live ammunition is being fired is provided. The method includes attaching a blank firing adapter to a muzzle of the firearm. The method also includes providing an interior chamber that is in communication with the muzzle of the firearm and providing an opening for expanding gas to escape from the interior chamber. The method also includes providing a port that is separated from the interior chamber by a barrier of sufficiently low strength so as to allow a projectile designed for use with the firearm to pass through the barrier whereby when such a projectile passes through the barrier the expanding gas escaping through the port create a sound of at least approximately 10 dB greater than when a blank is fired.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE FIGURES

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
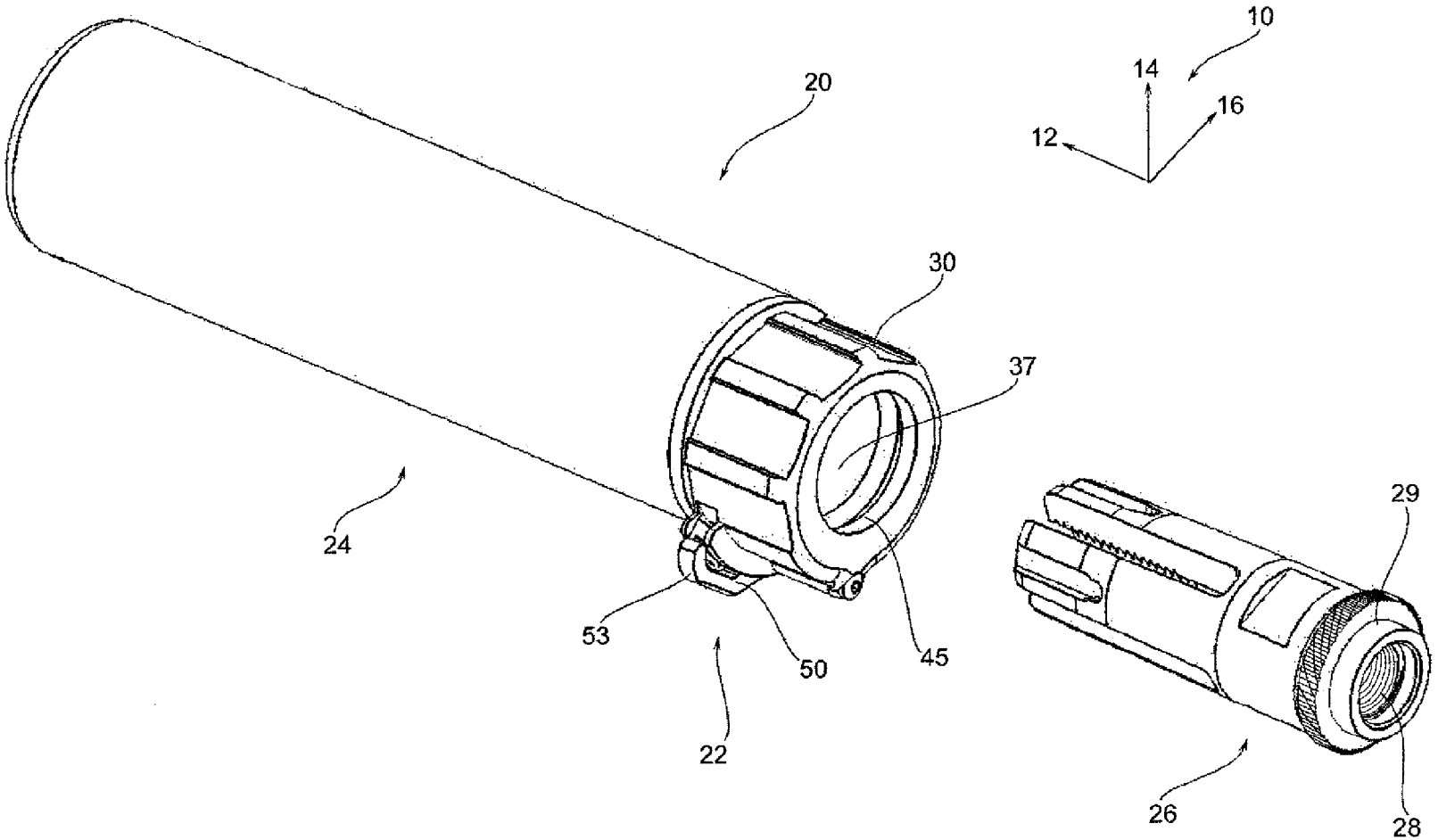
FIG. 1 shows a firearm attachment positioned adjacent to a flash suppressor adapted to be mounted to the muzzle of a firearm in accordance with an embodiment of the invention.

As shown in FIG. 1, there is a firearm attachment 20 such as a suppressor or blank firing adapter which in general comprises a locking assembly 22 and a suppressor body 24. The firearm attachment 20 is operatively configured to be attached to a muzzle 26 (e.g., a muzzle region or muzzle portion) of a firearm. FIG. 1 generally shows only a muzzle flash suppressor which is configured to be attached to a barrel by way of the threaded portion 28. An axes system 10 is defined where the axis 12 defines a longitudinal forward direction, the axis 14 defines a vertical direction, and the axes 16 defines a lateral direction pointing to the right-hand lateral direction by reference of the operator of the firearm. It should be further noted that the axes 14 and 16 both generally indicate a radial direction with reference to the centerline of the suppressor body 24. Further, a tangential direction is defined as a general direction perpendicular the radial direction.

Figure 2:
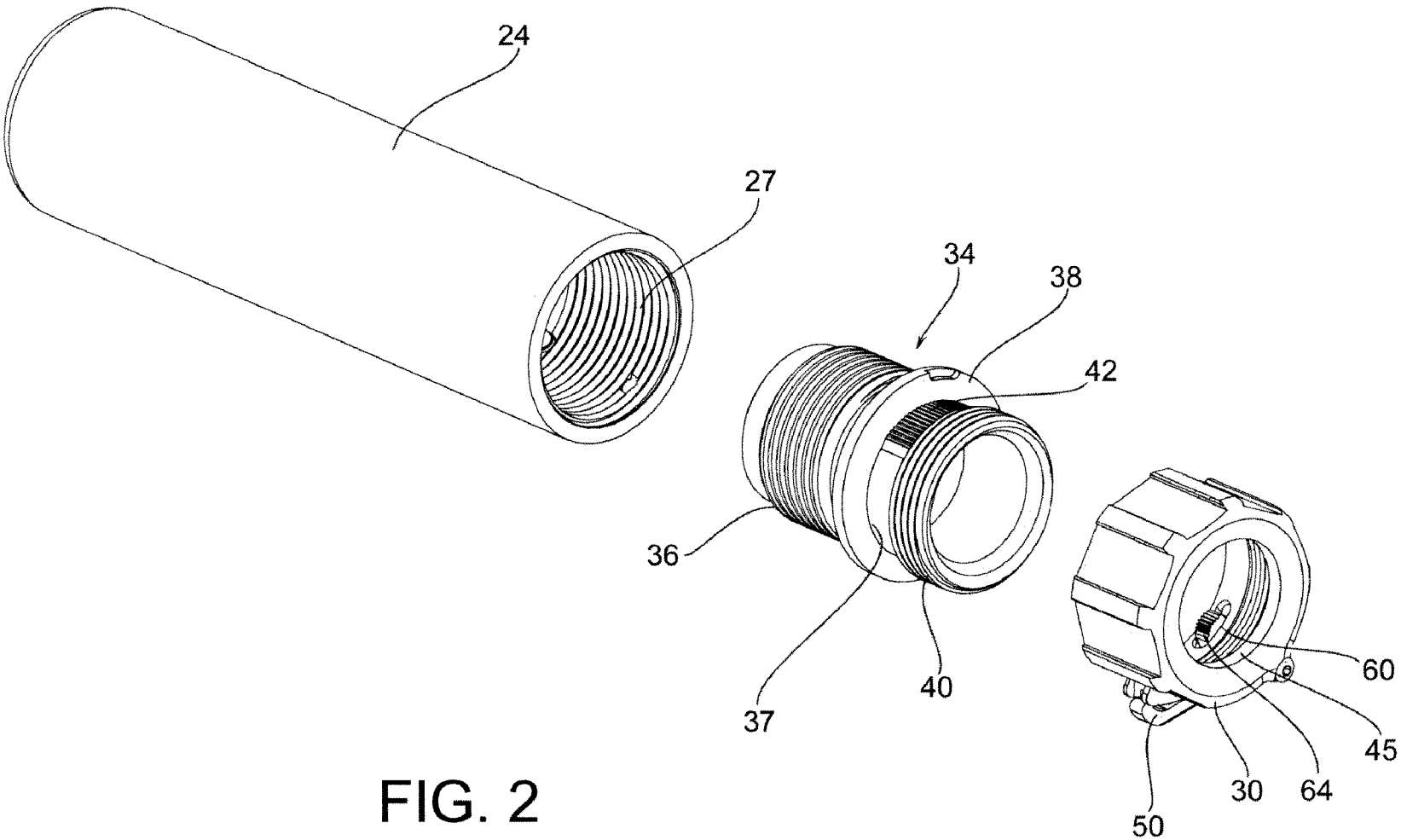
FIG. 2 shows a partially exploded view of a firearm attachment in accordance with an embodiment of the invention.
Figure 19:
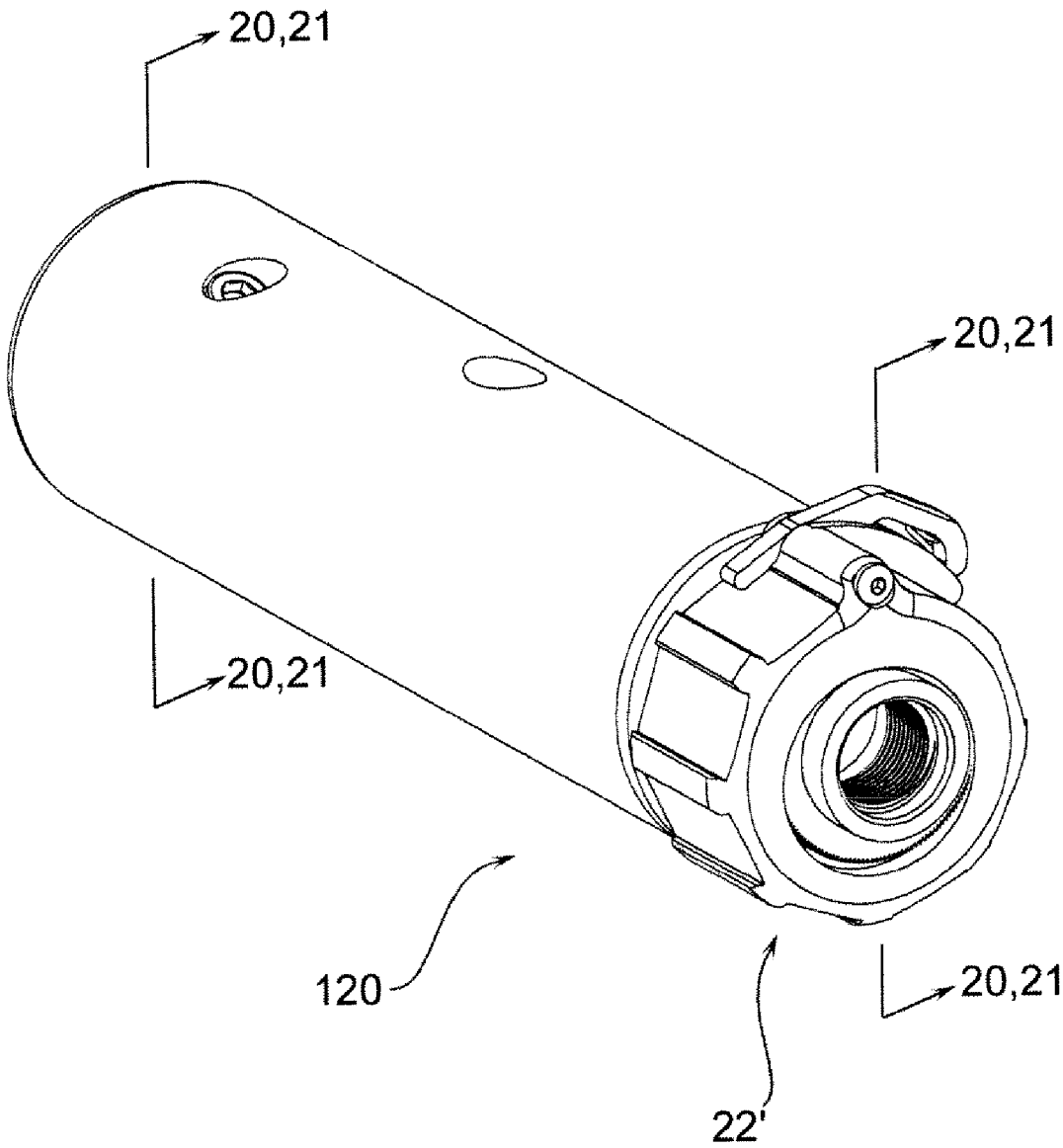
FIG. 19 shows a firearm attachment which is a blank firing adapter in accordance with an embodiment of the invention.

In general, the locking assembly 22 can be utilized in a variety of embodiments to lock a suppressor body 24 to a firearm or lock an attachment such as a blank firing adapter 120, as described further herein in FIG. 19. In one embodiment, the locking assembly 22 comprises a lock ring 30 that is operatively configured to rotate with respect to the base mount 34, which is best shown in FIG. 2 in a partially exploded view. In general, the base mount 34 is provided with a body attachment region 36 which in one embodiment is a threaded cylindrical member configured to attach to the base attachment 27 of the suppressor body 24 (see FIG. 2). The base mount 34 further comprises a lock ring attachment region 40 which again in one embodiment is operatively configured to be threadedly attached to the lock ring 30. A base flange 38 is provided on the base mount 34 and is interposed between the body attachment region 36 and the lock ring attachment region 40. Positioned adjacent to the base flange 38 is a locking surface 42 which in one embodiment has a plurality of substantially longitudinal extending indentations operatively configured to engage the lock extension 62 of the lock-and-release lever 50 described further herein (see FIG. 4). In general, the locking surface 42 can be formed of a plurality of types of mechanical locking and frictional engagement-type locking surfaces as well as smooth surfaces. The various geometries with respect to the lock extension 62 engaging the locking surface 42 in conjunction with the rotation of the lock ring 30 will be described herein in detail. In general, in one embodiment, the longitudinally extending ridge of the lock engagement surface 64 of FIG. 4 can either be used directly upon a base mount 34 or upon a muzzle portion or directly upon a firearm.

Figure 3:
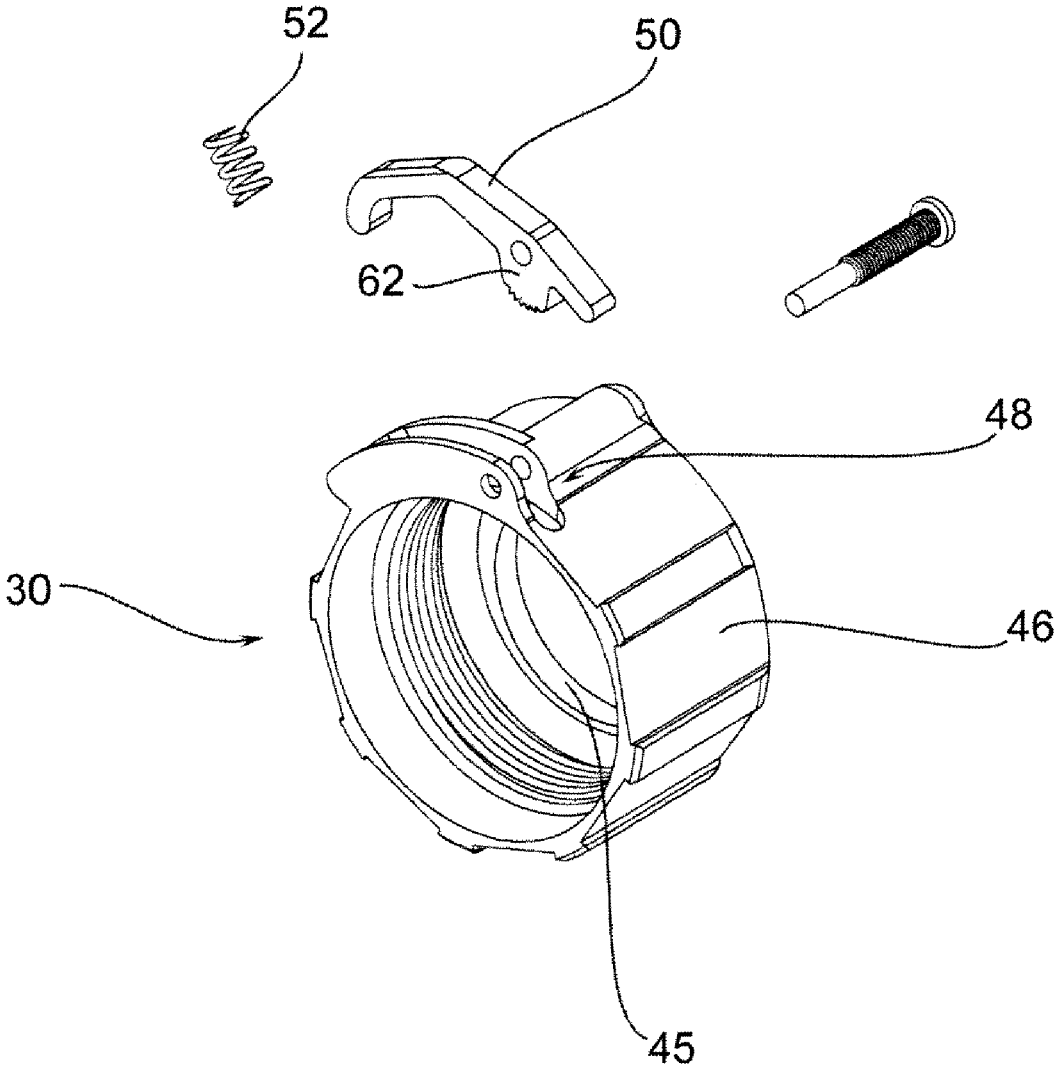
FIG. 3 shows an exploded view of a lock ring configured to be a portion of the firearm attachment in accordance with an embodiment of the invention.
Figure 4:
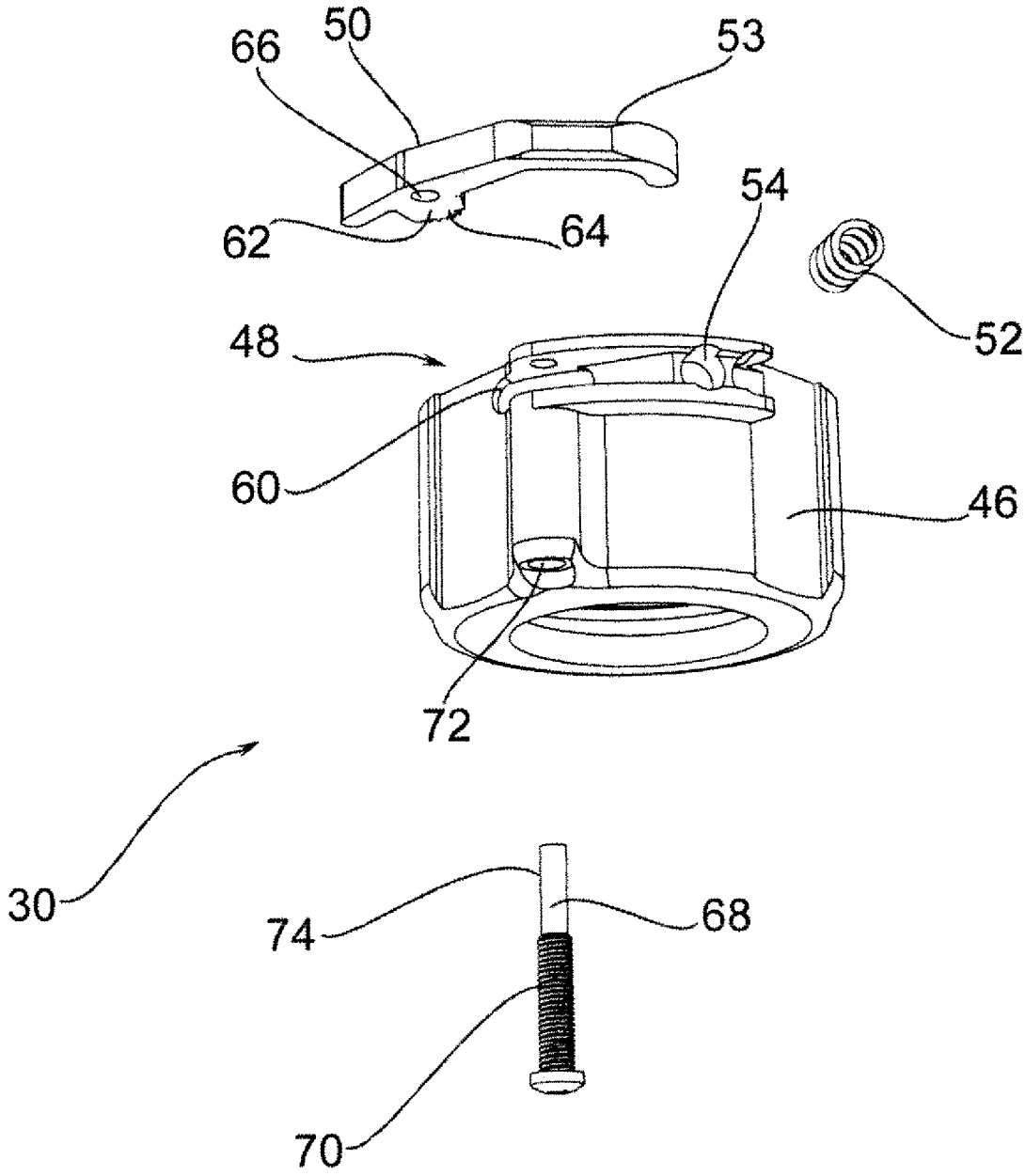
FIG. 4 shows another exploded view of a lock ring taken from a vantage point looking upon the fastener housing of the lock ring in accordance with an embodiment of the invention.

As shown in FIG. 3, the lock ring 30 is shown in an exploded view. In general, the lock ring 30 comprises a base ring 46 having a locking region 48. The locking region 48 is configured to have the lock-and-release lever 50 in one embodiment pivotally mounted thereto. As shown in FIG. 4, there is a isometric vantage point view looking at the locking region 48 where it can be seen that the biasing member 52, which in one embodiment, can be a helical spring, which is configured to be fit within the surface defining a biasing member base 54 that can be an indentation roughly the diameter of the biasing member 52 so as to fit the biasing member 52 therein to be interposed between the lock-and-release lever 50 and the base ring 46.

The base ring 46 further comprises, in one embodiment, a surface defining a lock opening 60 which is configured to allow the lock extension 62 of the lock lever to extend therethrough as shown, for example, in FIG. 2 in the lower right-hand portion. In general, the lock extension 62 comprises the lock engagement surface 64 which is operatively configured to engage the locking surface 42 as described further herein. The lock-and-release lever 50, in one embodiment, is pivotally attached at the pivot attachment location 66, which is operatively configured to receive the fastener 68 (see FIG. 4). In general, the fastener 68 can be arranged in a plurality of embodiments, but in one embodiment, the threaded portion 70 can be received within the fastener housing 72 of the base ring 46 and the extension 74 extends through the attachment location 66 of the lock-and-release lever 50.

Figure 5:
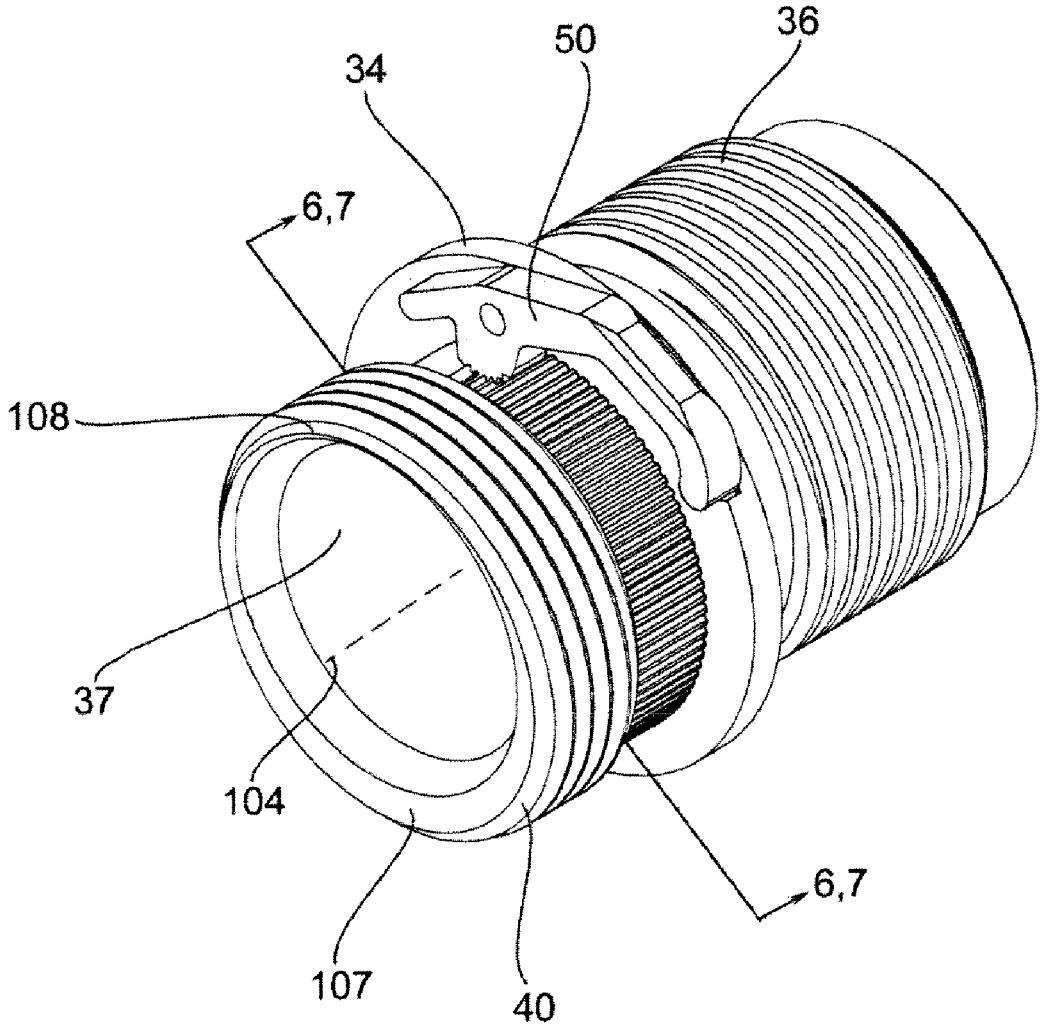
FIG. 5 shows a partial component view of the lock ring only showing the lock-and-release lever positioned in an engaged position with the lock surface of the base body, and is shown for illustrative purposes of describing the mechanism where in operation, the lock-and-release lever would be pivotally attached to the lock ring which in turn is attached to the base body in accordance with an embodiment of the invention.

To further explain the dynamics of the engagement of the lock engagement surface 64, the lock-and-release lever 50, the base mount 34, and in particular the locking surface 42, reference is now made to the isometric view in FIG. 5, which only shows the base mount 34 with respect to the lock-and-release lever 50 when the lock lever is arranged in a locking orientation. It should be reiterated that the lock-and-release lever 50, in practice, is assembled to the base ring 46 to form a complete unit, as shown in FIG. 2. However, for purposes of explanation of the geometries, to simplify the discussion in FIGS. 5 and 7A-7G, the related structural components are not shown for purposes of simplicity of explanation.

Figure 6:
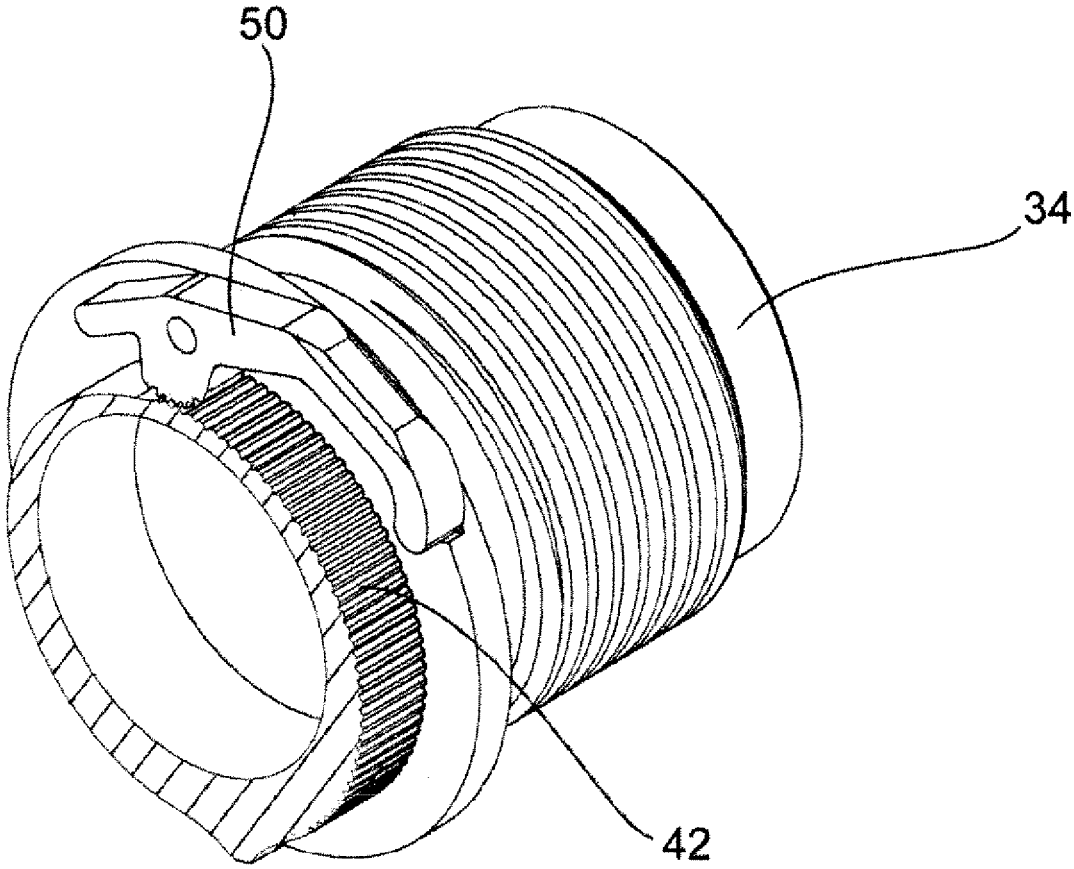
FIG. 6 shows the base body in a sectional view whereby the lock ring attachment region which is threaded is thereby removed from view in accordance with an embodiment of the invention.

FIG. 5 shows the isometric view of the base mount 34 and the locking lever 50, where the cut line 6,7-6,7 provides a cut plane having a perpendicular axis in the longitudinal direction. FIG. 6 shows a sectional view where the lock ring attachment region 40 having the threaded portion of a larger diameter in one embodiment is not shown. Now referring to FIG. 7A, it can be seen that there is a front view taken along the cut plane in FIG. 6, illustrating in detail the geometric relationship of the lock-and-release lever 50 and the locking surface 42 of the base mount 34. In general, the lock lever is provided with the biasing member 52, as shown in FIG. 3, to provide a torquing force upon the lock lever indicated by the vector 71 (see FIG. 7A). Of course, in the broader scope, a plurality of rotational forces can be applied upon the lock-and-release lever 50 in various configurations. A rotational torque on the lock-and-release lever 50 is one operational element to provide forceful engagement between the lock engagement surface 64 and the locking surface 42.

Figure 8:
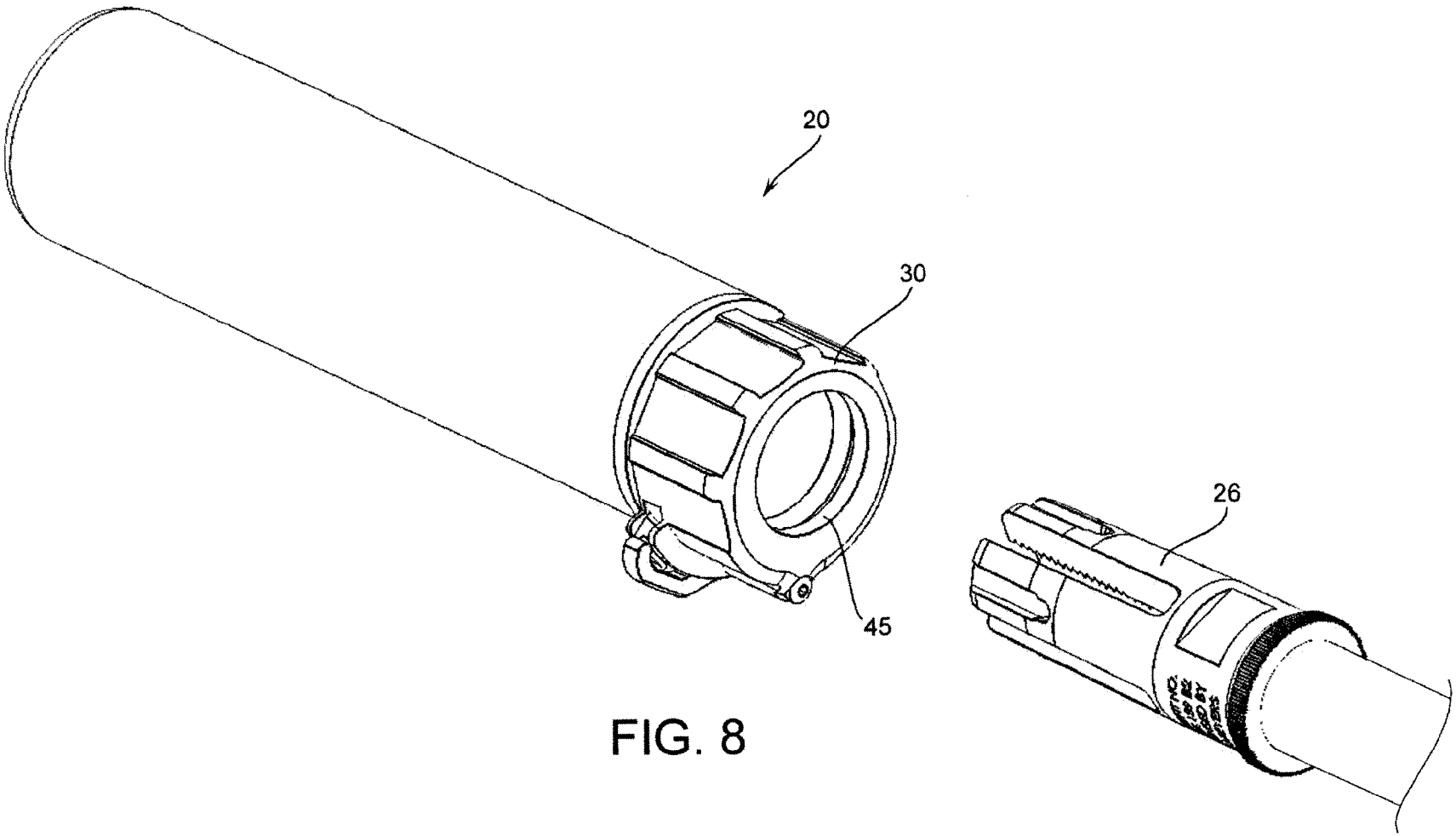
FIG. 8 shows the firearm attachment in an unlocked orientation positioned adjacent to the muzzle of a firearm in accordance with an embodiment of the invention.
Figure 9:
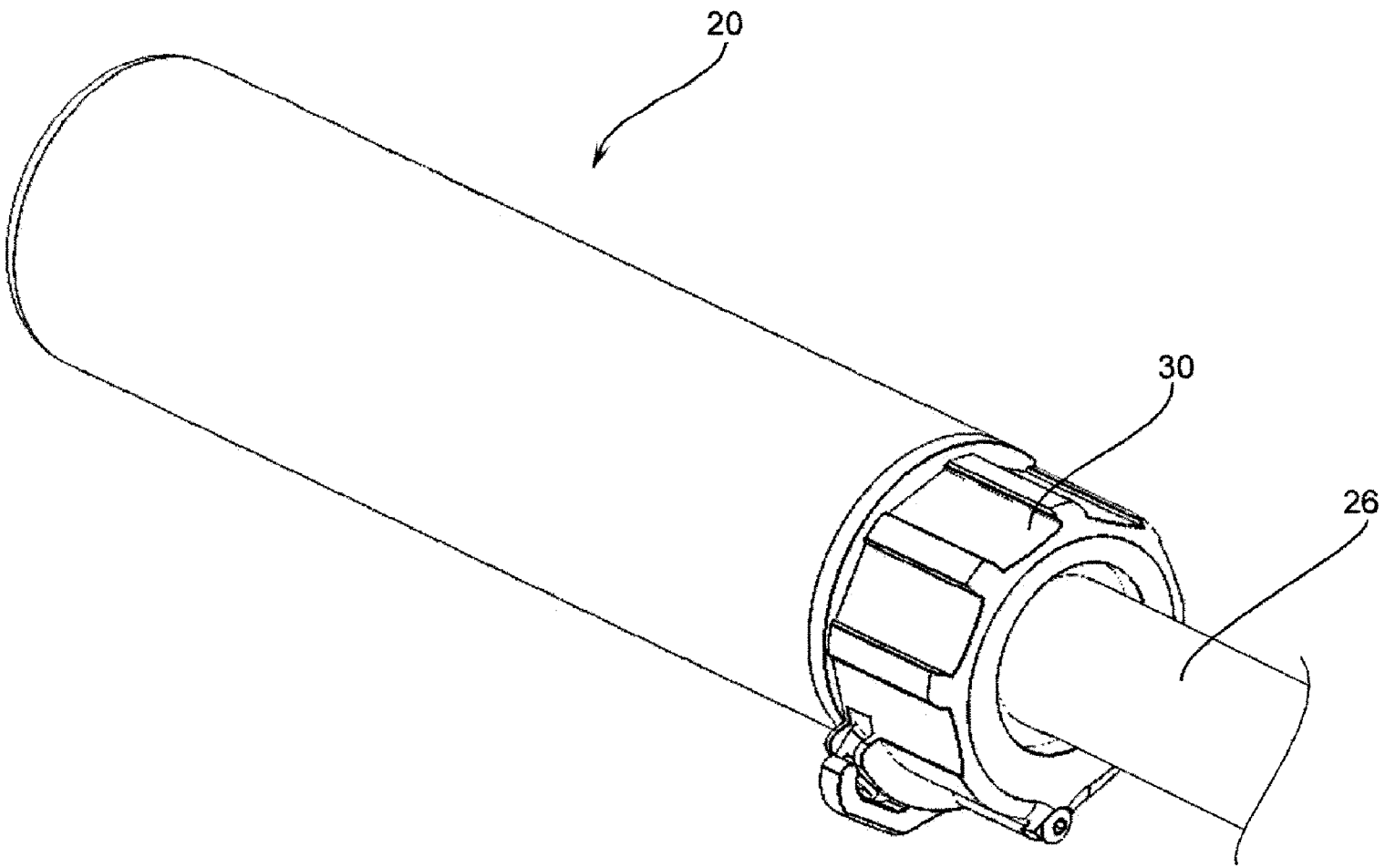
FIG. 9 shows the muzzle inserted into the firearm attachment with the lock ring in an unlocked orientation in accordance with an embodiment of the invention.
Figure 10:
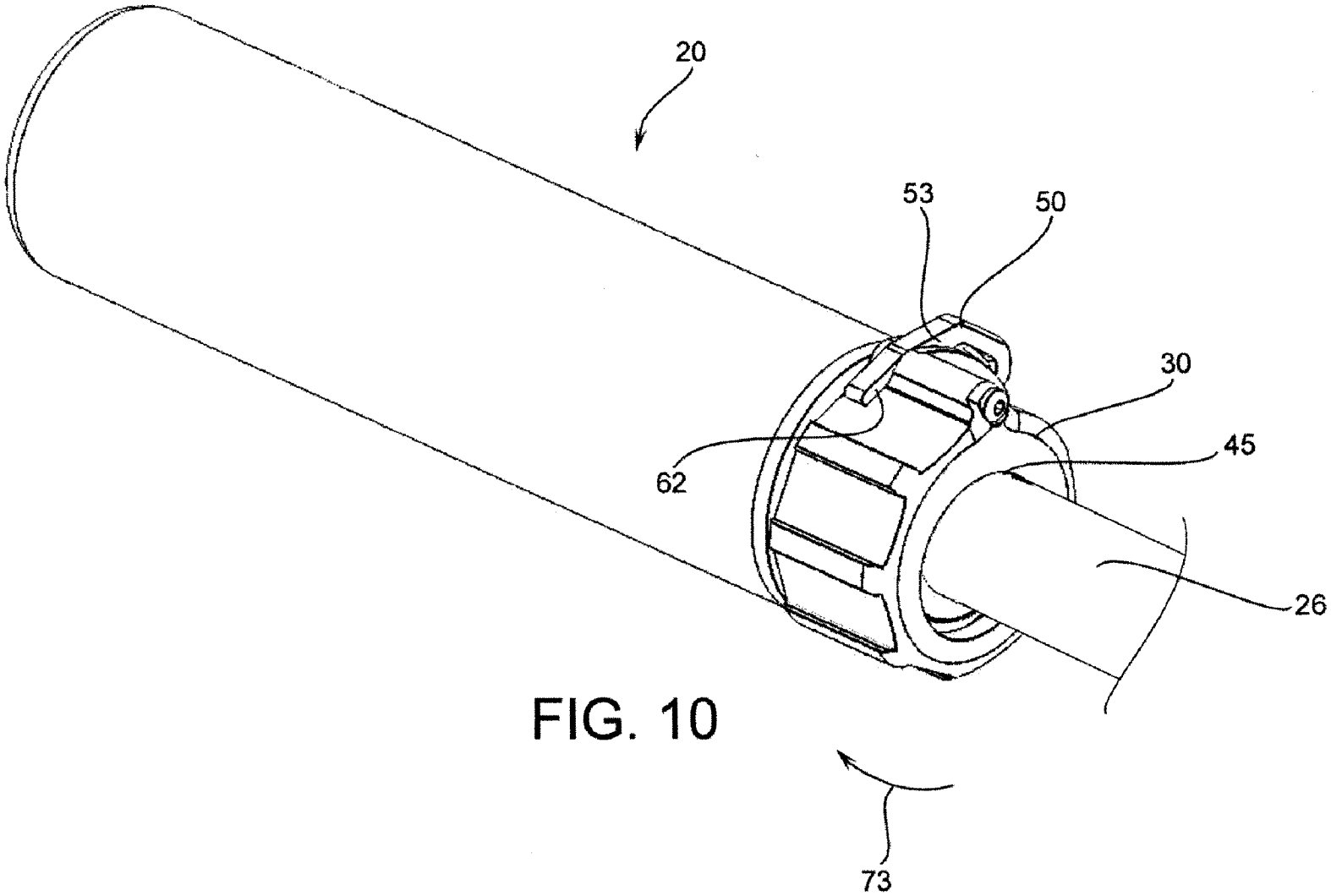
FIG. 10 shows a lock ring rotated into a locked orientation in accordance with an embodiment of the invention.

Before further describing the dynamics of the geometries, orientations, and arrangement of the surfaces, there will first be an overview of the locking operation with reference to FIGS. 8-11. As shown in FIG. 8, the firearm attachment 20 is shown in an isometric view positioned adjacent to the muzzle 26 of a firearm. It should be noted that the orientation of FIG. 8 is an unlocked orientation of the locking assembly 22. The unlocked orientation is where the lock ring 30 is rotated counterclockwise (in one embodiment) such that the non-concentric engagement surface 45 added above to FIG. 3 is in substantial alignment with the inner surface 37 which, in one embodiment, is cylindrical of the base mount 34 (see FIG. 3). Now referring to FIG. 9, it can be seen that the muzzle 26 is inserted into the suppressor 20. Finally, FIG. 10 shows the lock ring 30 rotated counterclockwise from the perspective of the operator of the firearm (or, of course, the lock ring could be rotated clockwise with a symmetrically opposite arrangement). It can generally be seen that the non-concentric engagement surface 45 is now in tight frictional engagement with the muzzle 26 so as to rigidly attach to the suppressor 20 thereto. In one embodiment, the frictional engagement of the non-concentric engagement surface 45 is such that experimentation has found that the suppressor will be rigidly mounted to the muzzle of a firearm given the geometries of the non-concentric engagement surface 45 described further herein. However, the lock-and-release lever 50 provides a secure engagement so as to ensure that the suppressor 20 is not removed from the firearm unless the release 53 of the lock-and-release lever 50 is pressed.

Referring back to FIG. 7A, it can be appreciated that, when in the locked orientation, the lock engagement surface 64 of the lock-and-release lever 50 in particular is provided with a plurality of engagement teeth 80, which can generally have the dimensions and properties of a knurled surface. In general, the plurality of engagement teeth 80 generally has a force engagement region 82 shown in FIG. 7A having a center of force generally indicated by the force vector 84. Therefore, it can be appreciated that the center of force vector 84 is positioned in the left-hand portion of the radial reference line 86. In other words, as the vector 71, which indicates the force of the biasing member 52 creating a moment upon the lever 50, forcefully engages the plurality of engagement teeth 80 upon the force engagement region 82, this force engagement region will not pass the radial reference line 86 so as to reduce the effect of the locking engagement between the lock engagement surface 64 and the locking surface 42 (the locking force between the lock ring 30 and the base mount 34).

Figure 7A:
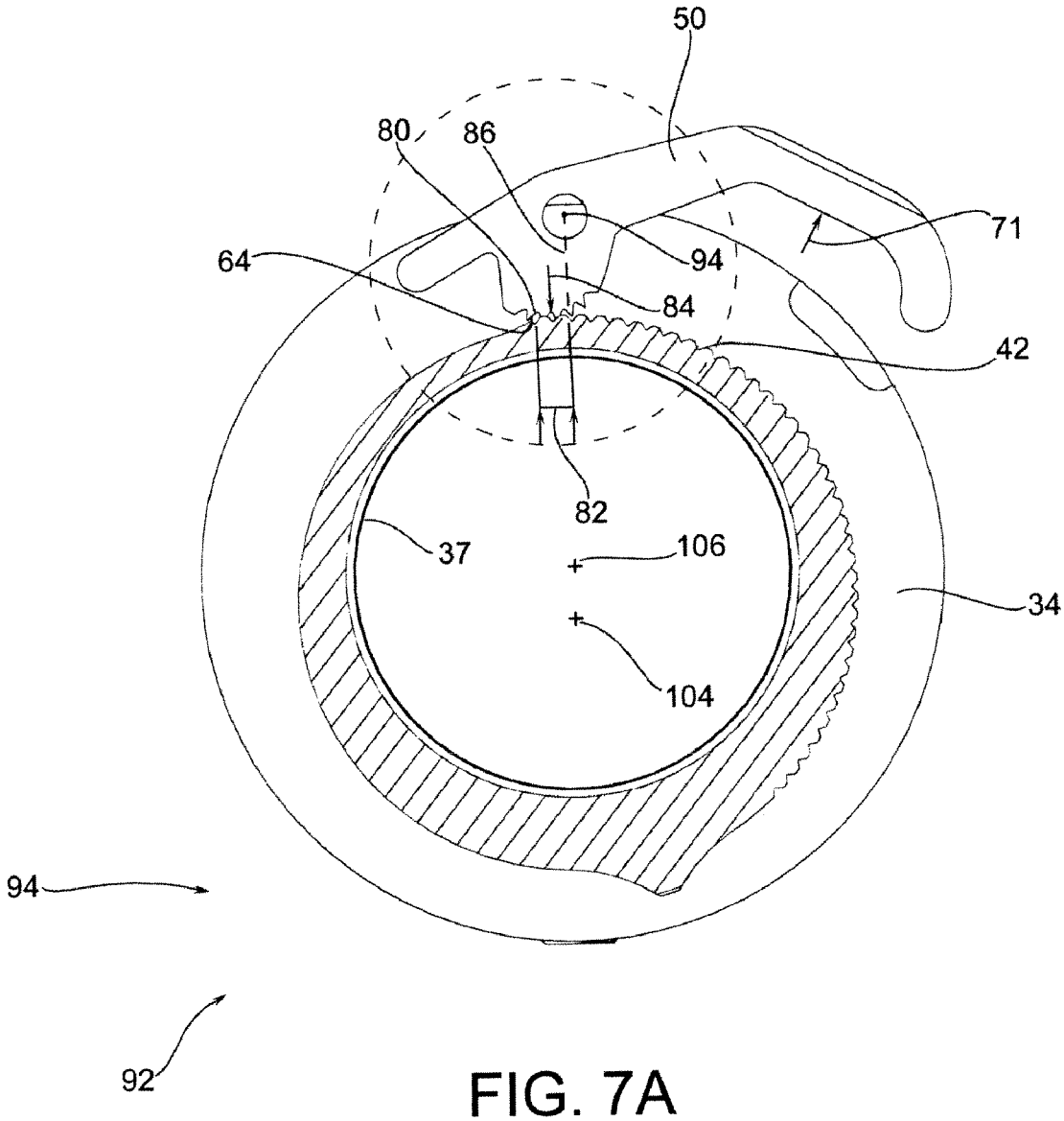
FIG. 7A is taken along line 6,7-6,7 of FIG. 5 where the engagement between the base body and the lock-and-release lever can be seen in accordance with an embodiment of the invention.
Figure 7B:
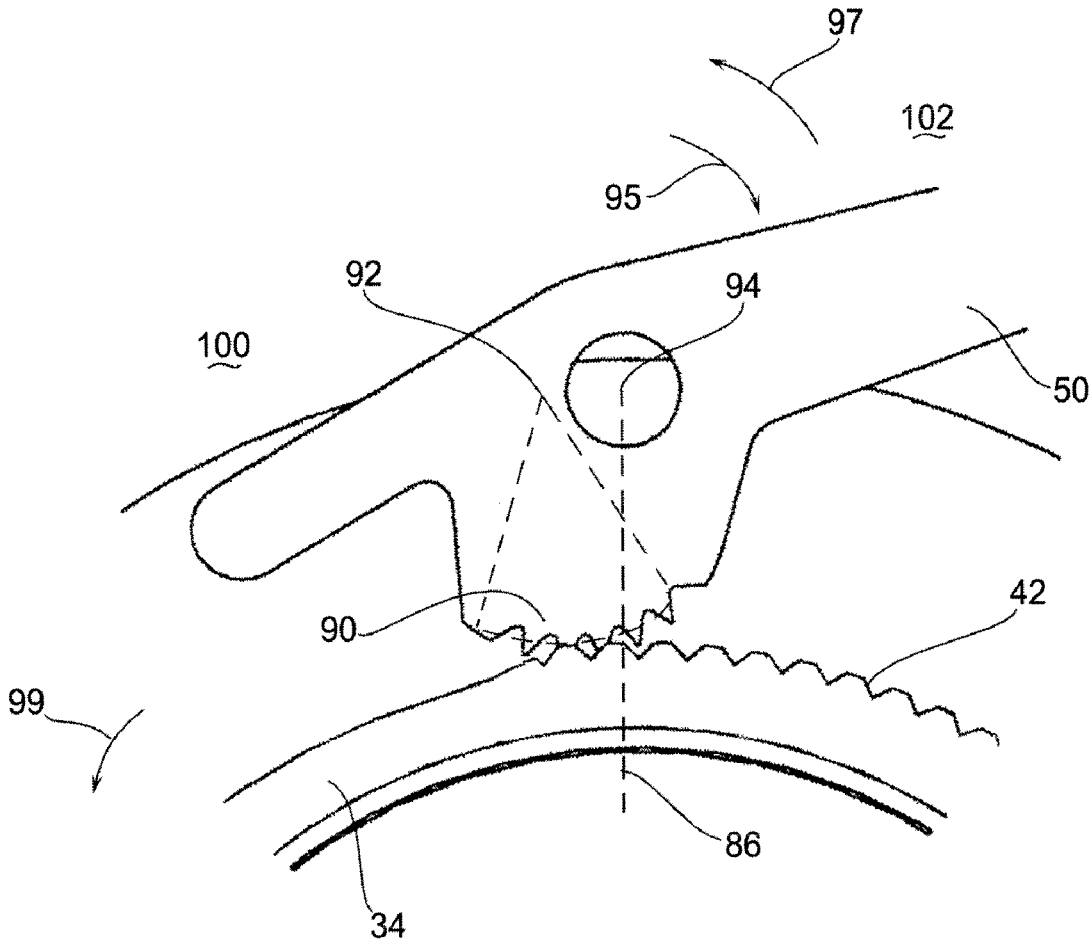
FIG. 7B shows a close-up view of the lock-and-release lever, and more specifically an engagement of the lock engagement surface and the locking surface of the base body in accordance with an embodiment of the invention.

It should further be noted, as shown in FIG. 7B showing a close-up view of the plurality of engagement teeth, that the reference arc 90 generally has a center 92 that is non-concentric with the pivot mount providing a center of rotation 94 of the lock-and-release lever 50. As the lock lever rotates in the lock rotation 97 about the center of rotation 94, the lock engagement surface 64 is in greater forceful engagement with the locking surface 42. When the lock-and-release lever 50 is rotated in the unlock rotation 95, the surface 64 disengages to allow the lock ring 30 to rotate in the unlock direction 99. More specifically, the center 92 of the reference arc 90 is positioned in the same region as the center of force vector 84 with respect to the radial reference line 86. To aid in the description of the orientation of the rotation points and surface engagement regions, the region indicated at 100 is orientated in FIG. 7B to the left lower region of the radial reference line 86. The region 100 is defined as the lock maintenance region. The opposing region 102 which is shown in the right-hand portion of the radial reference line 86 is referred to as the unlock region. The radial reference line 86 is defined as the radially extending line intersecting the center of rotation 94 of the lock-and-release lever 50 to the center of rotation of the lock ring 104 as shown in FIG. 7A. In general, the center rotation of the lock ring 104 is the center of the lock ring attachment region 40 such as that shown in FIG. 5. It should be noted that the center longitudinal axis 106 as best shown in FIG. 7A is positioned above or otherwise offset from the center of rotation of the lock ring 104. Of course, in one embodiment, the center longitudinal axis is positioned thereabove, but in other embodiments needs to be offset in a radial direction. The center longitudinal axis 106 is, in general, the geometric center of the muzzle. As seen in FIG. 5 the lock ring attachment region 40 is provided with threads rotating about the center of rotation and lock ring 104. These threads 40 are generally offset from threads providing the body attachment region 36. In other words, as shown in FIG. 5, the region indicated at 107 is thicker in the radial direction than the diametrically opposed region indicated at 108. Of course referring back to FIG. 2, it can further be appreciated that the lock ring is provided with the engagement surface 45 that is not concentric with the base mount attachment surface 110, which in one embodiment is a threaded region to be threadedly attached to the lock ring attachment region 40 of the base mount 34.

Figure 7C:
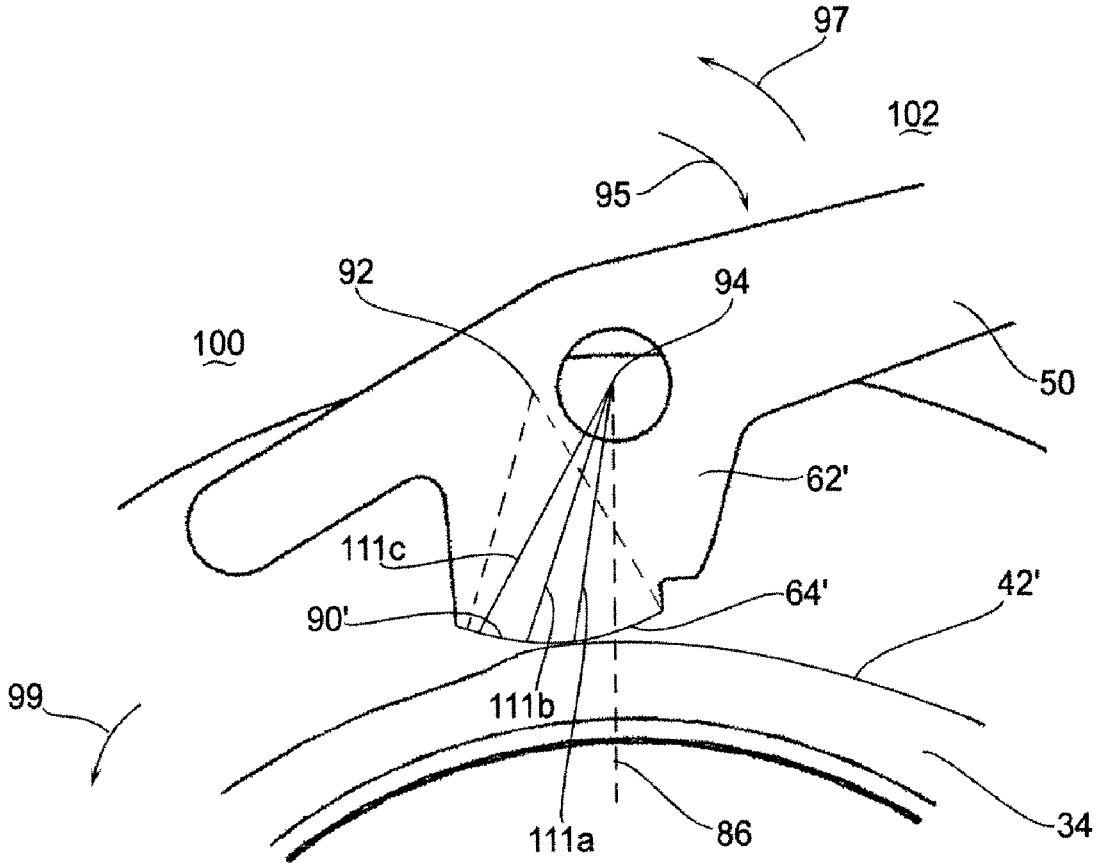
FIG. 7C shows another embodiment where the locking surface and the lock engagement surface are a substantially smooth surface, and shows various distant vectors illustrating a geometric relationship between these two surfaces in accordance with an embodiment of the invention.

Now referring to FIG. 7C there is shown another embodiment where the base reference arc 90' is coincident with the lock engagement surface 64'. Further, the locking surface 42' is now shown as a surface in one embodiment without ridges. In general, when the locking ring is subjected to various external forces and vibrations to rotate the locking ring in an unlocked rotation indicated at the rotational vector 99, the frictional engagement between the lock extension 62' and the locking surface 42' is geometrically arranged as such to inhibit rotation unless the lock-and-release lever is pressed to disengage from the locking surface 42'. The center of base reference arc 92 is positioned in the lock maintenance region 100 which is the lateral region indicated in FIG. 7C from plane defined by radial reference line 86 and the longitudinal axis. FIG. 7C further shows another way of defining the base reference arc where the distance reference vectors 111*a*, 111*b*, and 111*c* are arranged so as to increase in length as these vectors advance toward the lock maintenance region 100. For purposes of disclosure, the distance reference vectors 111*a*, 111*b*, and 111*c* are to scale with respect to one another illustrating one embodiment of a surface geometry to properly maintain the lock ring in a locked orientation. In other words, as the lock-and-release lever 50 rotates in the lock rotation 97, the distance between a forceful engagement between the surfaces 64' and 42' and the center of rotation 94 increases, thereby causing more force to be exerted between the lock-and-release lever 50 and the base mount 34.

Figure 7D:
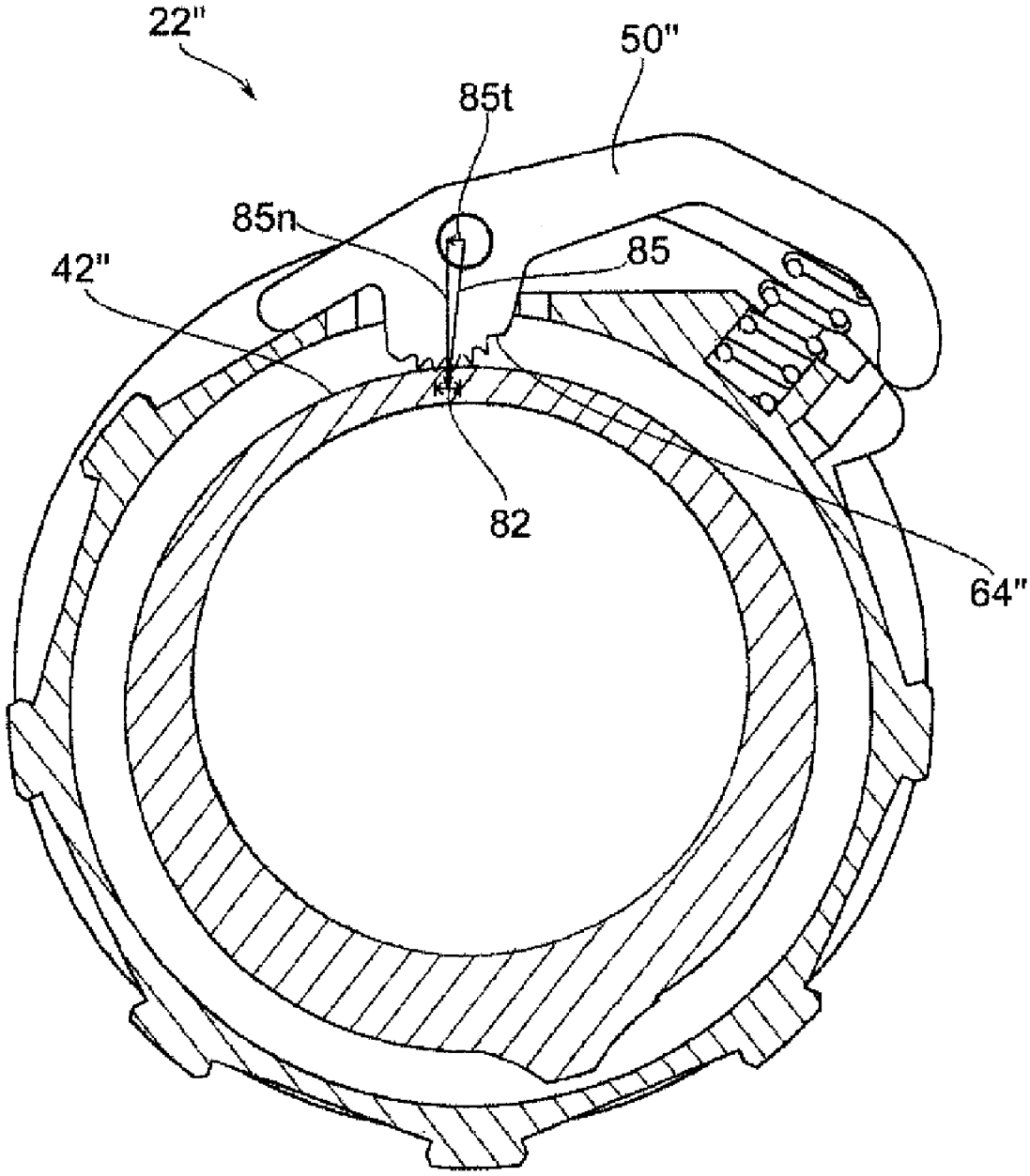
FIG. 7D shows another embodiment of an arrangement of surfaces between the lock engagement surface of the lock extension and the locking surface of the base body in accordance with an embodiment of the invention.

Now referring to FIG. 7D there is shown another embodiment of carrying out the locking assembly 22". As shown in FIG. 7B, the locking lever 50" is substantially similar to the locking lever as shown in, for example, FIG. 7A. FIG. 7D shows a locking surface 42" which in this embodiment is substantially smooth or otherwise provides fewer indentations than the locking surface 42 shown in FIG. 7A. With the correct geometries established between the locking lever 50' and the locking surface 42", a locked engagement can be provided where it can be appreciated that the amount of force exerted upon the locking surface 42" by the locking release lever 50" is indicated by the force vector 85. In general, the vector 85 is comprised of the vector components 85*n* and 85*t* to represent the normal and tangential components. As shown in FIG. 7D, the angle of vector 85*n* with respect to the vector 85 is approximately 10°. The ratios of normal component 85*n* and an orthogonal tangential component 85*t* where the ratio of force values between the normal component to the tangential component is at least 5:1 or greater such as 10:1 and 20:1. In a broader range this angle can be between 2° and 25°. Other ranges and/or ratios may be used in other embodiments. In general, the distribution of force of the vector 85 is located in the force engagement region 82 in a similar manner as discussed above with reference to FIG. 7A. Of course there is a certain amount of surface area engaging between the surfaces 64" and 42".

Figure 7E:
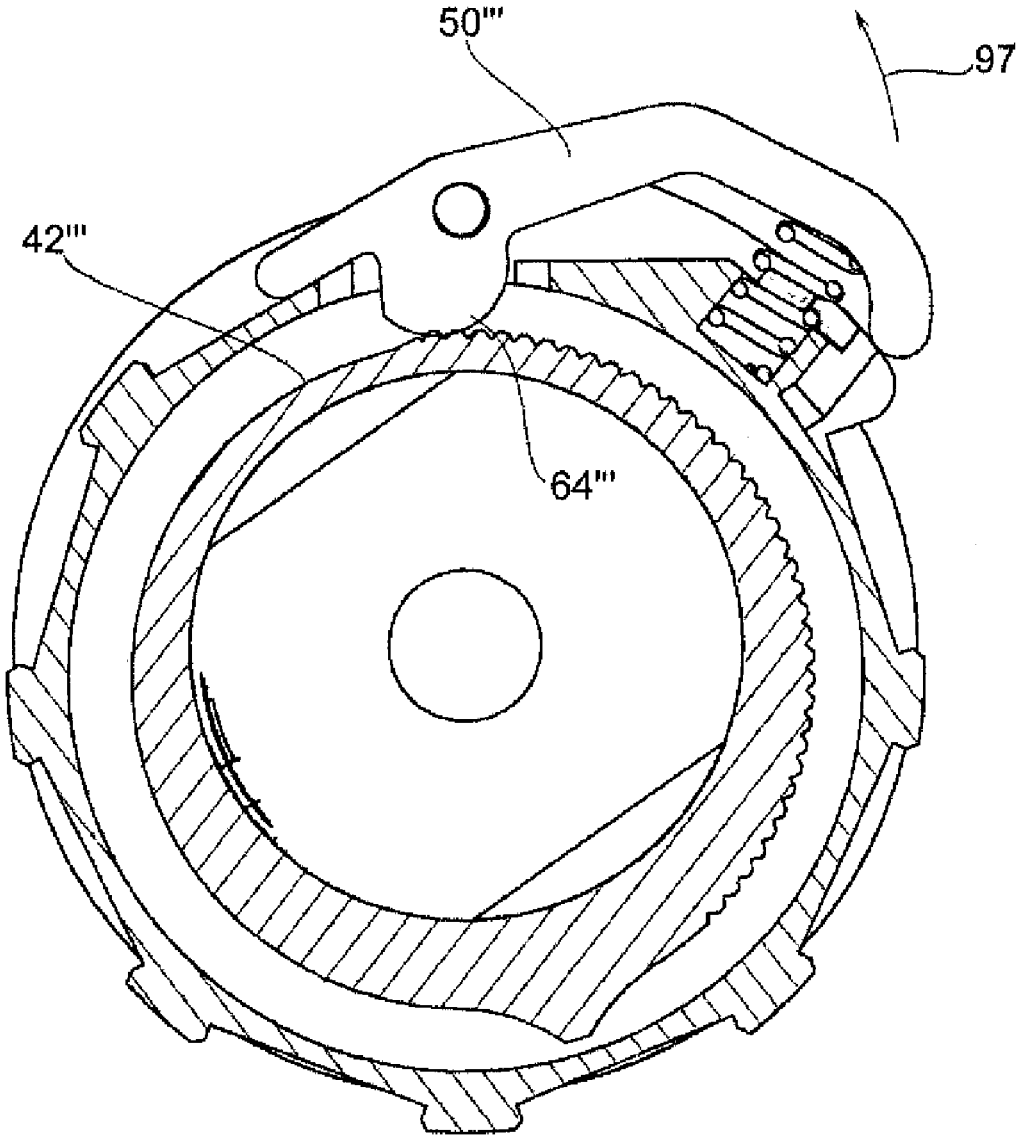
FIG. 7E shows another embodiment of different surface contours between the two main locking surfaces in accordance with an embodiment of the invention.

Now referring to FIG. 7E there is shown a locking release lever 50'" which comprises a locked engagement surface 64'" which is substantially smooth. The surface 64'" is basically coincident with a base reference arc 90 as described above in FIG. 7B. It can generally be seen how the lock rotation direction indicated at 97 would provide greater forceful engagement between the surfaces 64'" and 42'".

Figure 7F:
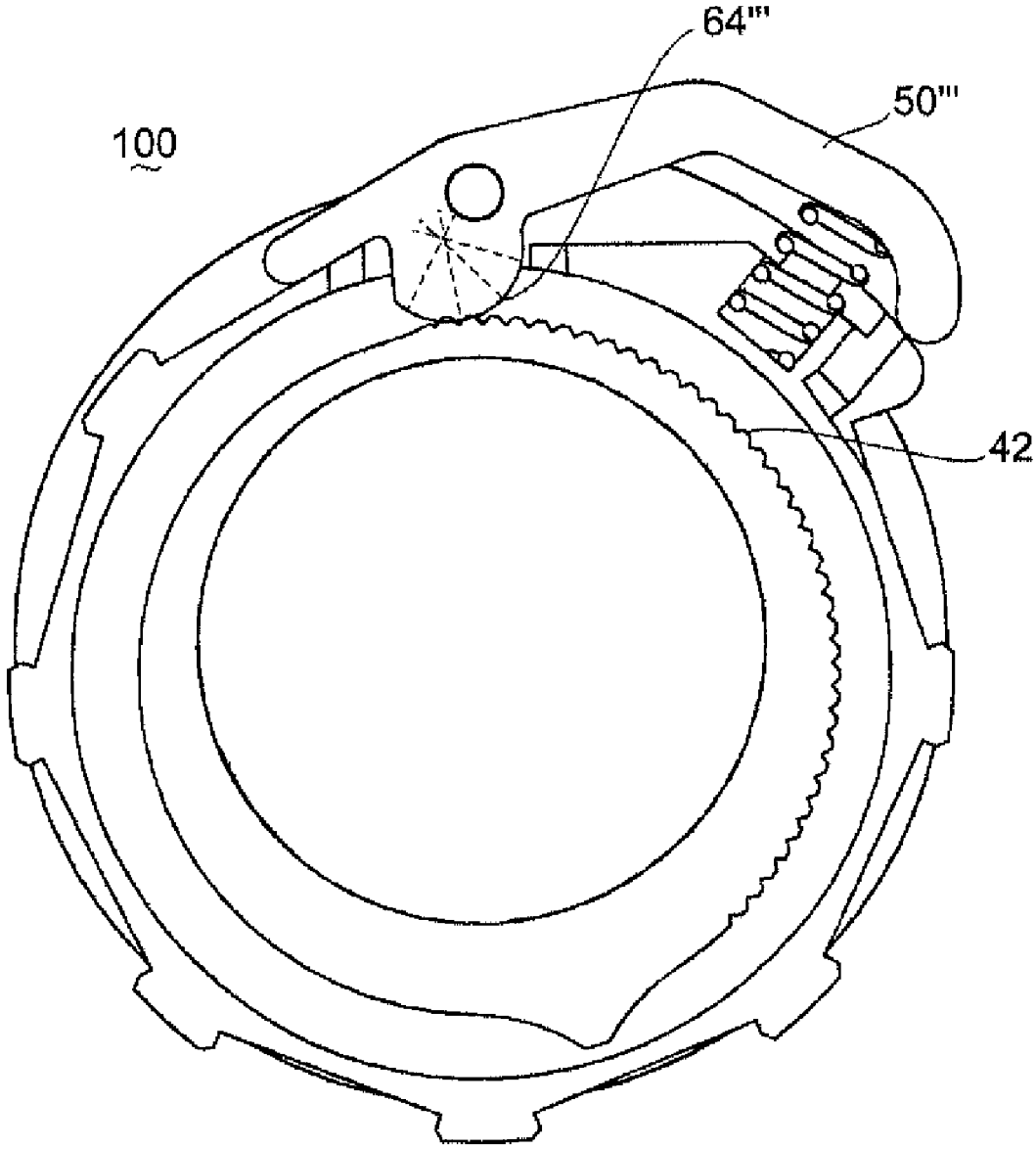
FIG. 7F shows another embodiment of an arrangement of a lock engagement surface of the lock-and-release lever in accordance with an embodiment of the invention.

Now referring to FIG. 7F, there is shown yet another variation where the locking engagement surface 64'" is similar to that shown in FIG. 7E, and the locking surface 42 is similar to that shown in FIG. 7A. In general, a plurality of types of engagement surfaces can be employed. In one embodiment, the relationship between the surfaces generally shown as 42 and 64 (with various suffix indicators to illustrate different embodiments and variations) can be arranged. As noted above, the various surfaces with the prefix reference numeral 64 can have a center arc that is generally orientated in the lock maintenance region 100. FIG. 7F shows various hashed reference lines indicating the normal component of the surface 64'" in one embodiment. Alternatively, as shown in FIG. 7C, the vectors 111 can increase in length (progressing from a greater length from 111*a* to 111*b* and a greater length from 111*b* to 111*e*, etc.). The rate of increase of these vectors can be between 2.5%-6% per 10 degrees of rotation from the center of rotation 94 relative to the diameter of the locking surface 42. Other rates of increase may be used in other embodiments. The coefficient of friction between the surfaces 64' and 42' have an effect upon the angle between the radial reference line 86 and the effect of contact between the surfaces 64' and 42' which is generally indicated at vector 111*a* which is approximately 10°. Other angles may be used in other embodiments. In one embodiment, the various images in the figures are to proportional scale. In general, the embodiment as shown in FIG. 7C can operate where effectively the surfaces 64' and 42' are smooth. As the lock ring tightens, it is preferable to not have any backing out of the lock ring (or firearm attachment in the embodiment in FIG. 27) whereby providing teeth and a larger angle of approximately 45° between the pivot point 94 and the engagement of the surface 64' would be too great of an angle and engagement teeth would be necessary. Other angles may be used in other embodiments. The greater the size of the teeth the more potential for having the lock ring "back out" to fit the closest sized engagement of teeth members. If the teeth are finer to provide finer adjustment, they are more susceptible to failure by way of introducing material between the teeth such as dirt, corrosion or otherwise failure by way of shear stress.

Figure 7G:
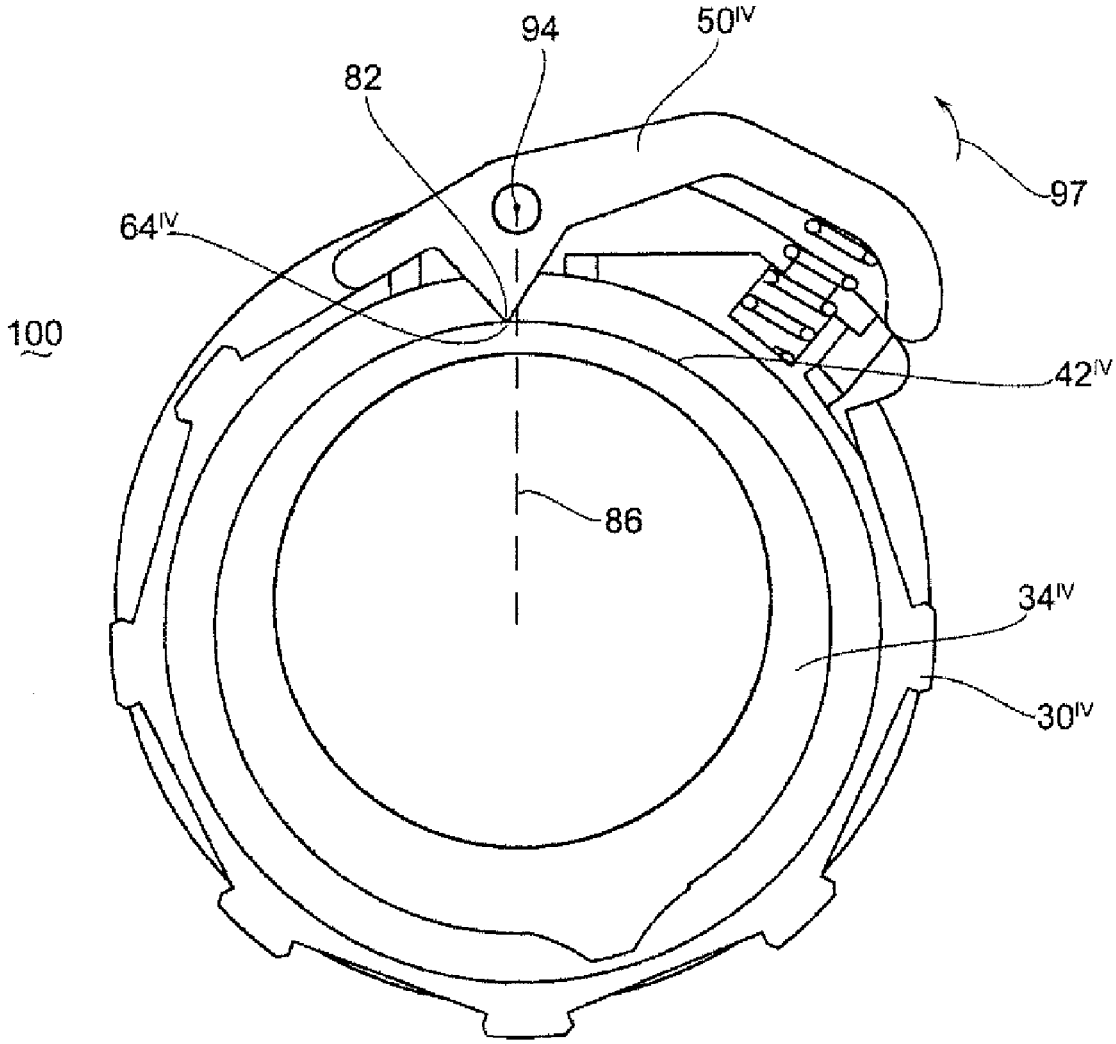
FIG. 7G shows another embodiment of a lock engagement surface having a finer point of contact which can be utilized in accordance with an embodiment of the invention.

Now referring to FIG. 7G there is shown yet another embodiment of a lock-and-release lever 50 IV, where in this embodiment the locking engagement surface 64IV is arranged as more of a point. In this embodiment, the engagement of the pointed portion at surface 64 to the locking surface 42 IV is located in the lock maintenance region 100 (to the first lateral portion of the plane defined by the radial reference line 86 and the longitudinal axis). In this embodiment, it can be appreciated that as the lock lever 50IV rotates in the lock rotation direction indicated 97, the point of contact between the lock lever and the base mount 34IV will provide forceful engagement to maintain the lock ring 30IV locked in place. Therefore, the embodiment in FIG. 7G basically shows a force engagement region 82 which is much smaller in tangential distance than that shown in, for example, FIG. 7A or FIG. 7D. Therefore, one embodiment of defining the engagement is to provide the central portion of the force engagement region to be positioned so as to not rotate past top dead center of the center of rotation 94 of the lock-and-release lever 50IV. In one embodiment, the angle from the radial reference line to the center of the force engagement region 82 is based from the center of rotation point 94 and is less than 10°, and in a broader range this value is less than 2° to 25°. In one embodiment, the range is approximately 7° plus or minus 20 percent. Other angles and/or ranges may be used in other embodiments.

Figure 11:
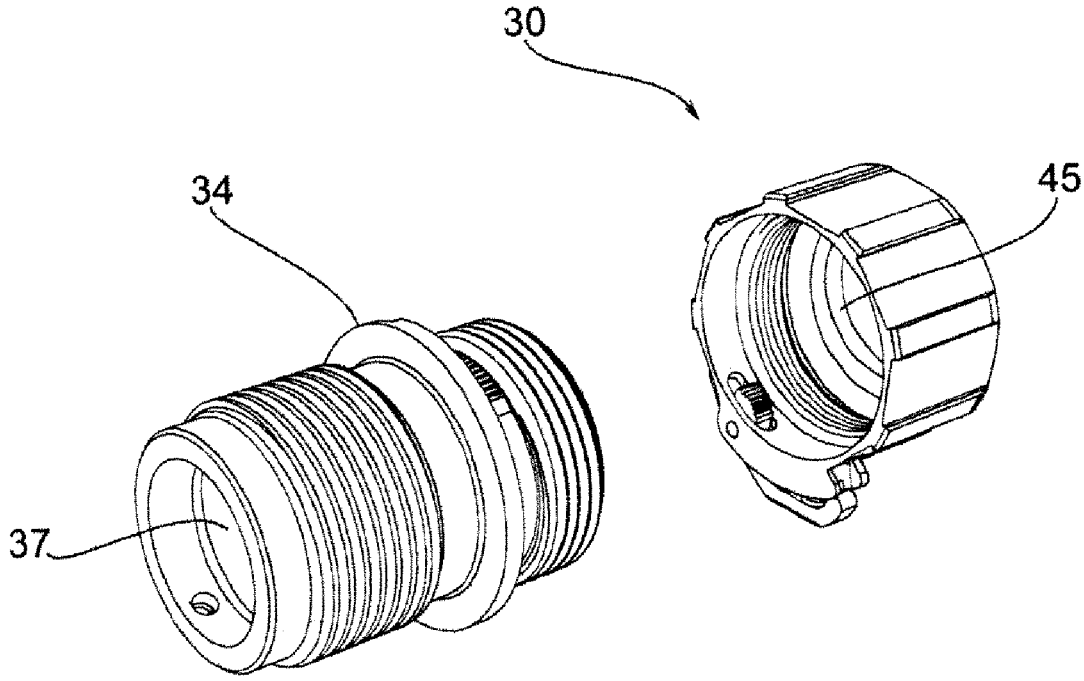
FIG. 11 shows the lock ring disengaged from the base body showing a rotating lock member in accordance with an embodiment of the invention.
Figure 12:
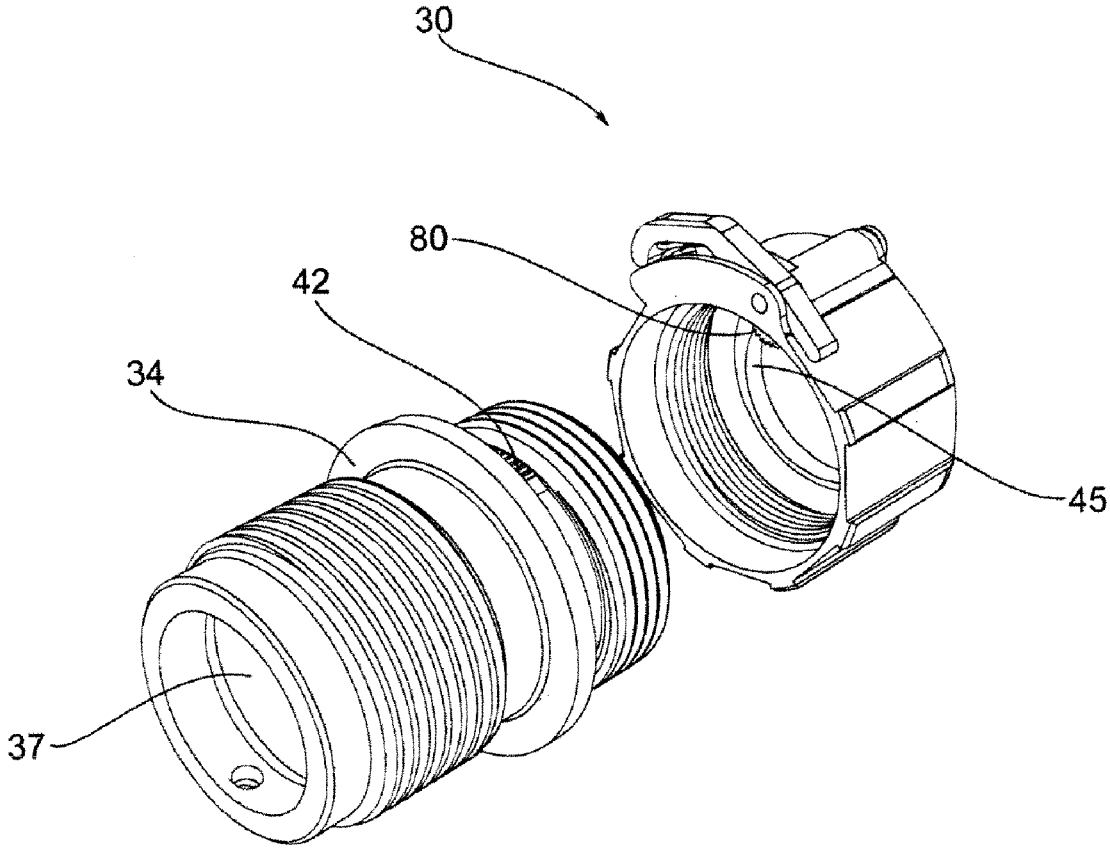
FIG. 12 shows a lock ring still positioned in an exploded view with respect to the base body, except the lock ring is now rotated into a locking orientation along the central longitudinal mutual axis between the lock ring and the base body in accordance with an embodiment of the invention.

FIG. 11 shows the locking ring 30 in an exploded view with respect to the base mount 34. In general, it can be appreciated that, in this orientation, the non-concentric engagement surface 45 of the lock ring is in substantial alignment with the cylindrical surface 37 of the base mount 34. In other words, the central axes of the surfaces 45 and 37 are substantially co-linear, and the cylindrical surfaces 37 and 45 (cylindrical in one embodiment) are of substantially the same diameter. Now referring to FIG. 12, it can be seen that the lock ring 30 is now rotated substantially 180° or a lesser amount of rotation than 180° in one embodiment, and it can be appreciated that the non-concentric engagement surface 45 is now in one embodiment still parallel to the central axis of the cylindrical surface 37 of the base mount 34, but is offset in this case in the vertically downward direction (but in general offset in any radial direction). Other angles may be used in other embodiments. It further can be noted in FIG. 12 that if the components 30 and 34 were assembled, the plurality of engagement teeth 80 would now be in engagement with the locking surface 42.

Figure 13:
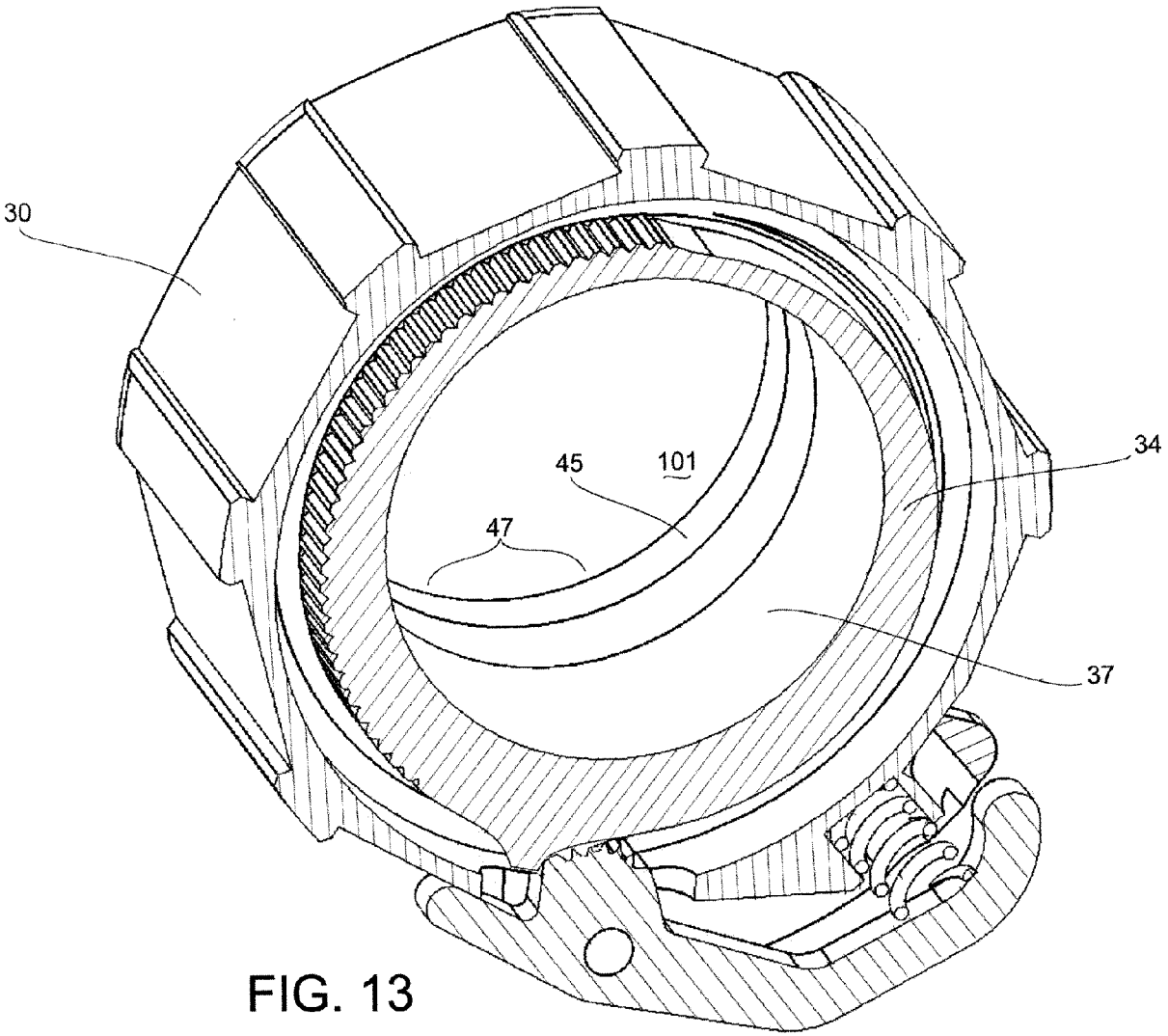
FIG. 13 shows an isometric sectional view of the lock ring engaging the base body in accordance with an embodiment of the invention.
Figure 14:
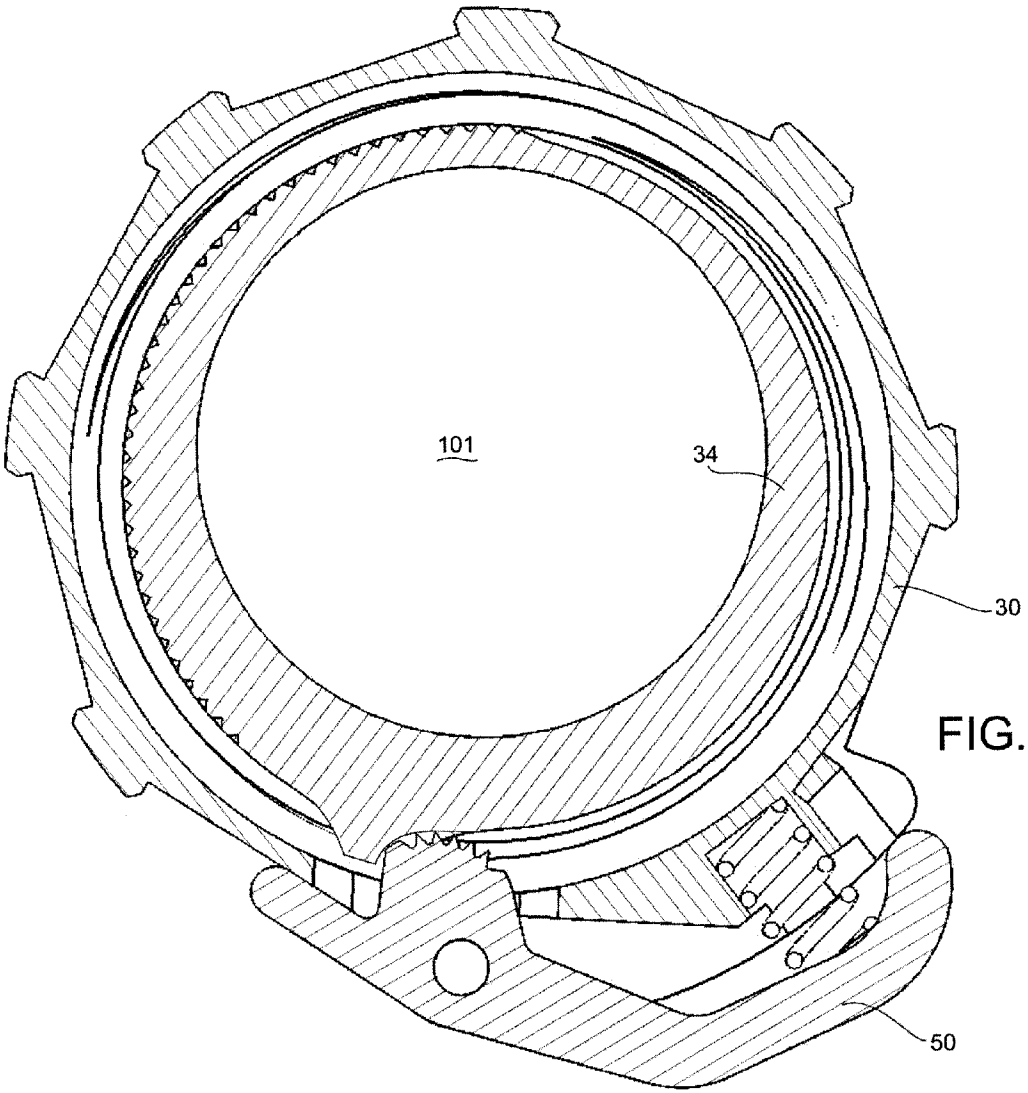
FIG. 14 shows a similar orientation of components of FIG. 13, except in a view taken along the longitudinal axis where the central open area is arranged to have a muzzle pass therethrough and the components are in an unlocked orientation in accordance with an embodiment of the invention.
Figure 15:
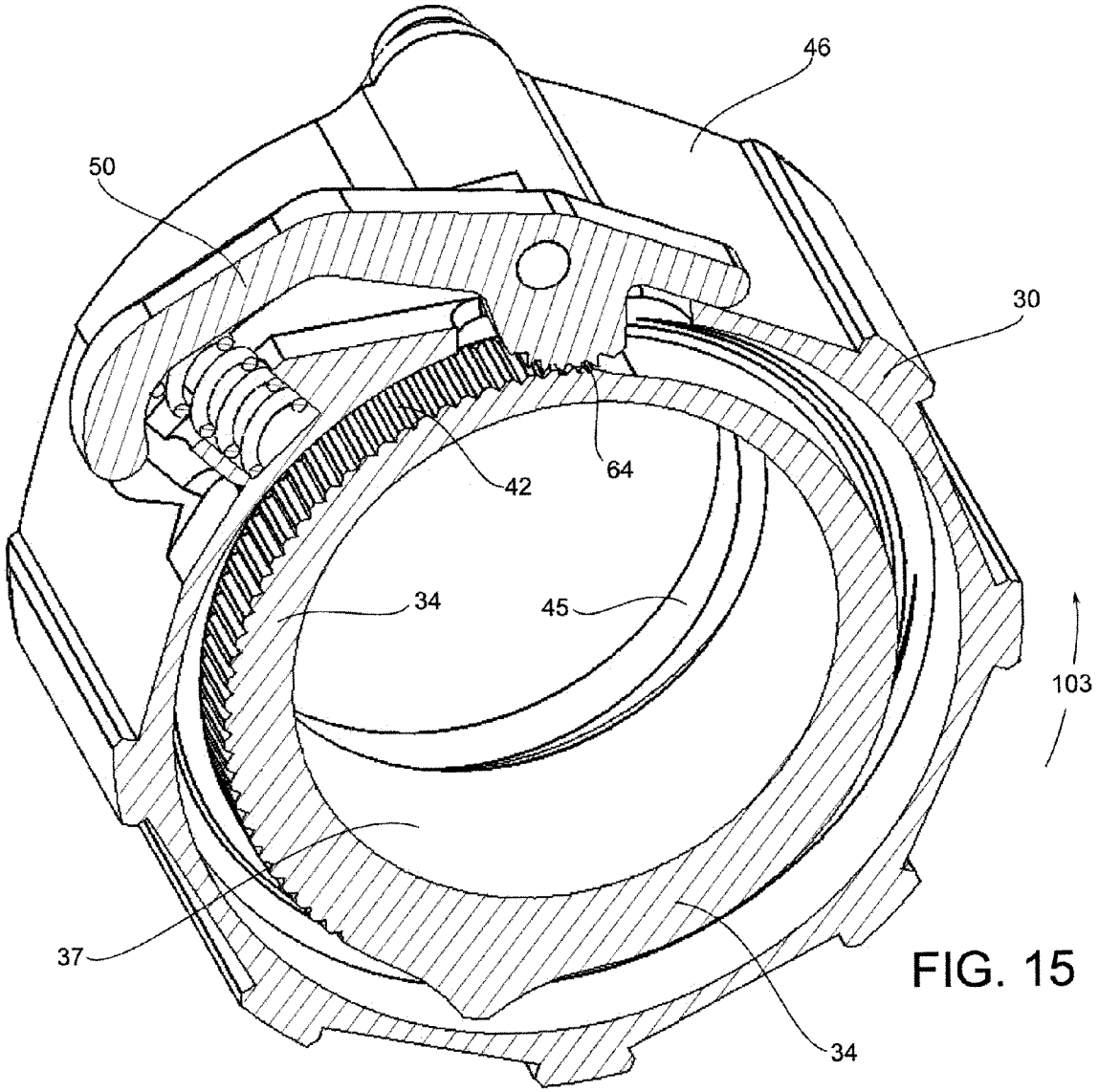
FIG. 15 is a sectional isometric view similar to that of FIG. 13 except the lock ring is now positioned in a locked orientation with respect to the base body in accordance with an embodiment of the invention.
Figure 16:
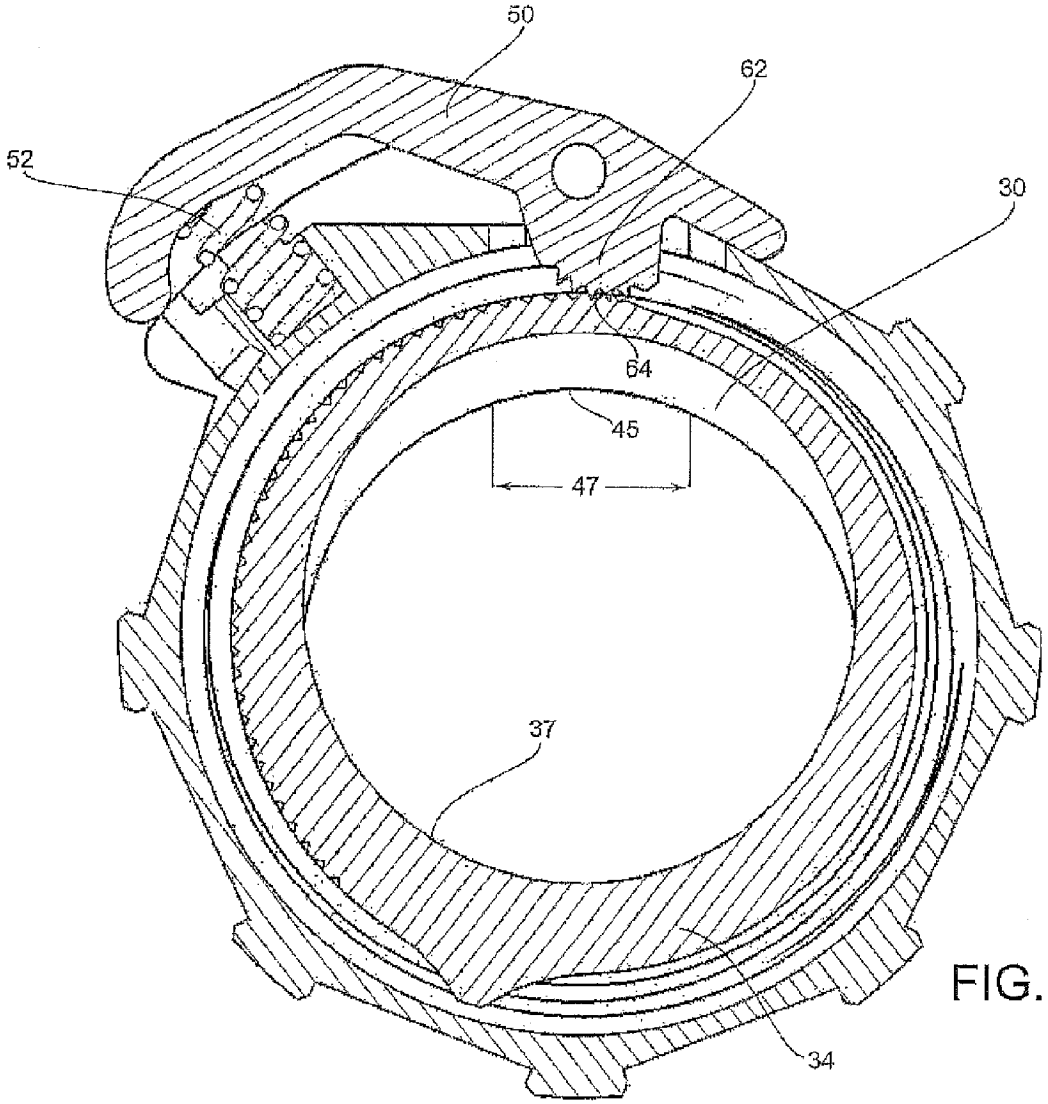
FIG. 16 is a view of the orientation of components in FIG. 15 except taken along the longitudinal axis where it can be seen that the non-concentric engagement surface is repositioned in the manner so as to forcefully engage the muzzle of a firearm, which can be the barrel or the muzzle attachment such as a flash suppressor or any other end portion of the muzzle region of the firearm in accordance with an embodiment of the invention.

FIG. 13 further shows a sectional view showing the base mount 34 in cross-section showing that the inner surface 37 of the base mount is substantially in-line with the non-concentric engagement surface 45 of the lock ring 30. FIG. 14 shows the sectional view in a non-isometric format directly along the longitudinal axis, illustrating the central open area 101, which is generally defined between the surfaces 37 and 45 of FIG. 13. It can be appreciated that the outer substantially conical surface of the muzzle 26 as shown in FIG. 1 is operatively configured to fit within the central open area 100. Now referring to the isometric view of FIG. 15, it can be appreciated that the lock ring 30 is rotated in the direction indicated by the rotational vector 103 so the lock-and-release lever 50 is now providing the lock engagement surface 64 to be engaged with the locking surface 42 of the base mount 34. As can be generally seen in FIG. 15, the non-concentric engagement surface 45 of the lock ring 30 and more particularly the solid unitary structure of the base ring 46 is now repositioned so as to no longer be in alignment with the inner surface 37 of the base mount 34. As better shown in FIG. 16, it can be seen that the non-concentric engagement surface 45 is now offset from the inner surface 37 of the base mount 34. More specifically, the muzzle engagement region 47 as shown in FIG. 16 is a portion of the non-concentric engagement surface 45, which is in forceful engagement with the outer surface of the muzzle (which broadly includes the barrel, a flash suppressor or any portion of the gun itself), and more particularly in engagement at the lock surface region 29 as shown in FIG. 1. Further, the opposing surface region upon the inner surface 37 of the base mount 34 has the more longitudinally forward and lower region of the muzzle forcefully engaged therewith to provide a lock between the suppressor 20 and the muzzle 26 of the firearm (see FIG. 1).

Figure 17:
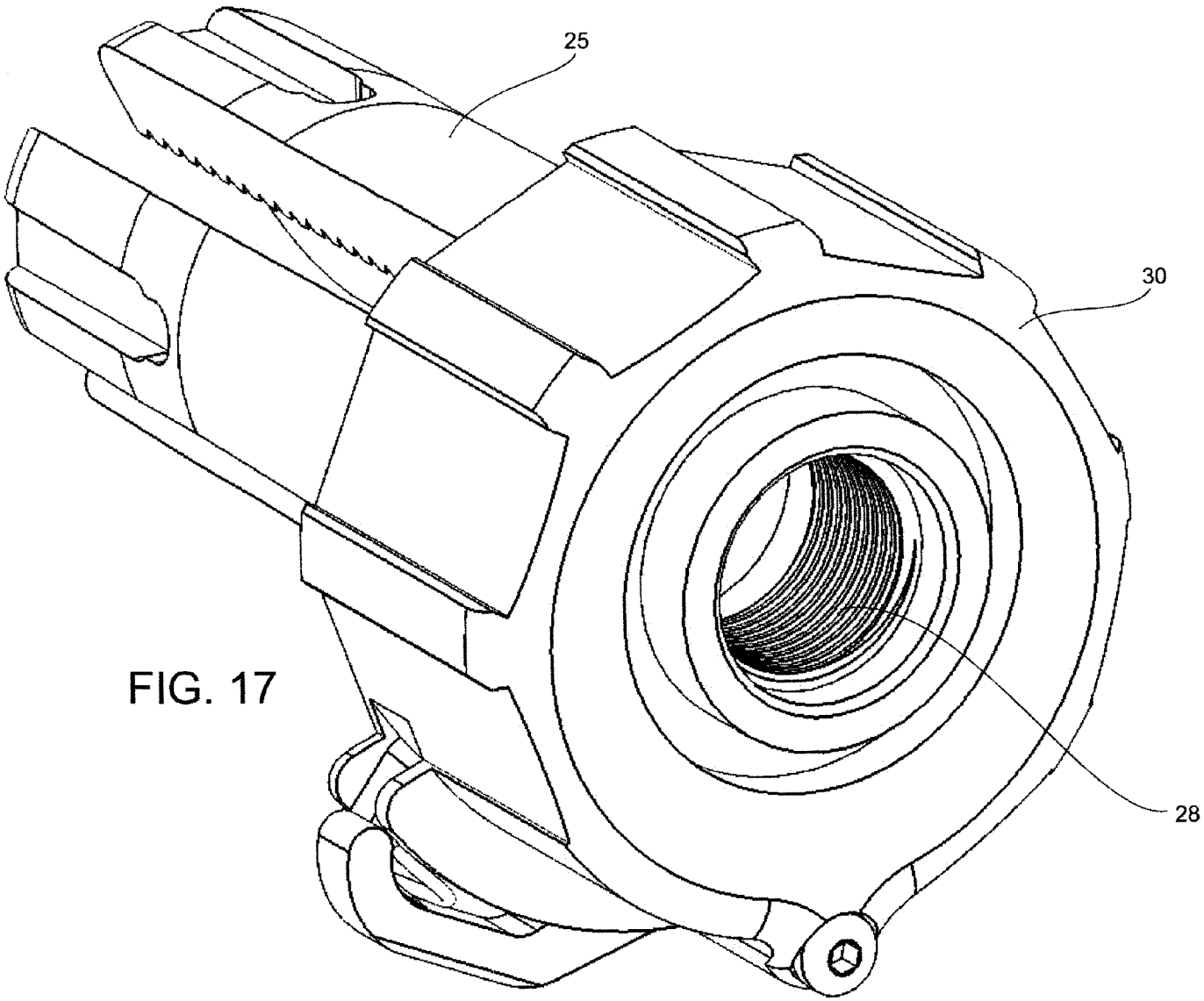
FIG. 17 shows a portion of a muzzle which is a threaded flash suppressor positioned in the lock ring where it can generally be seen that the lock ring is positioned in the unlocked orientation and the front central opening of the locking having a center axis is substantially co-linear with the central axis of the muzzle in accordance with an embodiment of the invention.
Figure 18:
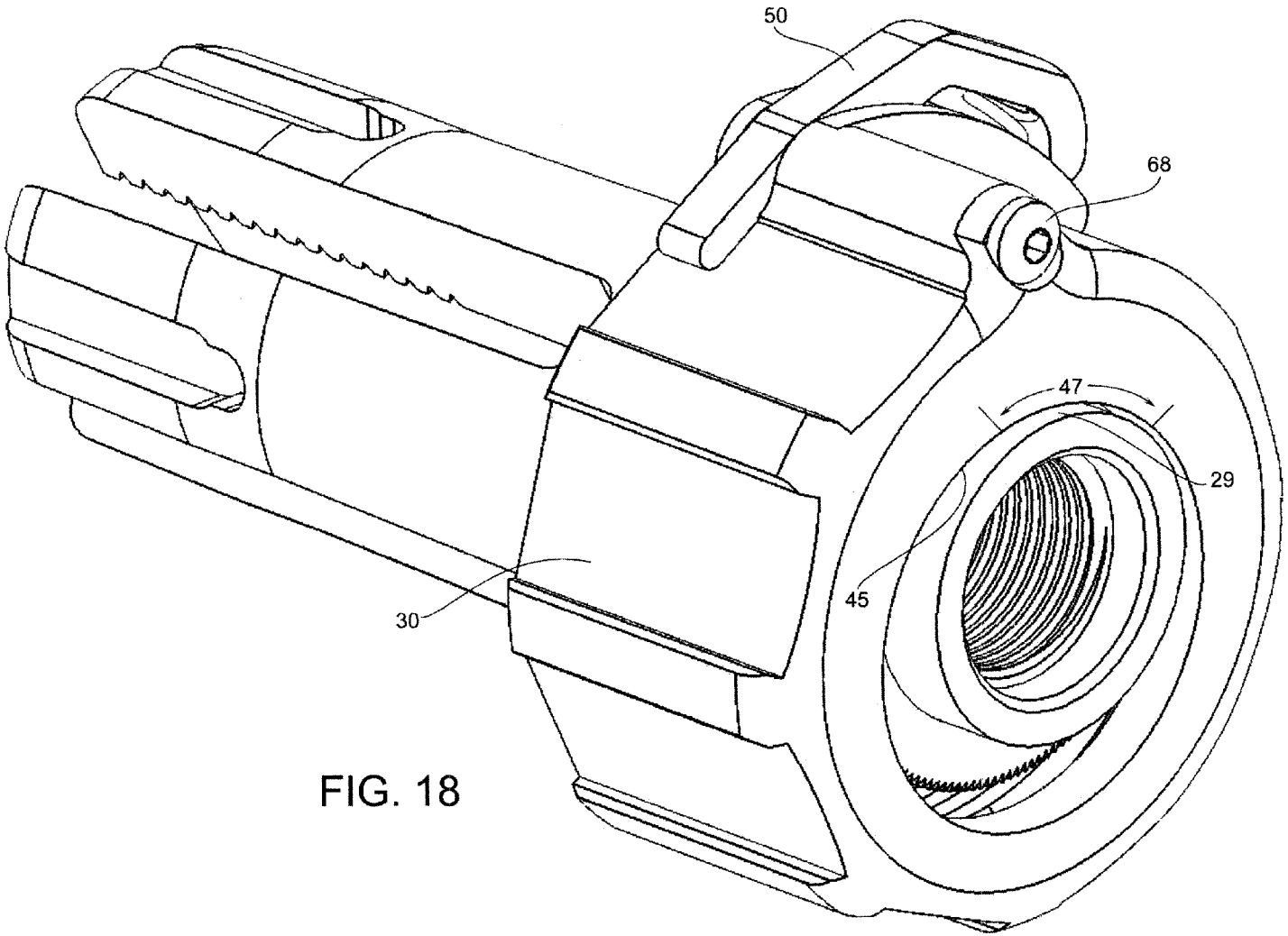
FIG. 18 shows the lock ring rotated into a locked orientation where the central axis of the front opening of the lock ring is now positioned offset from co-linear and substantially parallel from the central axis of the muzzle where it can be seen the engagement region is generally shown to be in forceful engagement with the muzzle which is shown here as the threaded adapter, such as a flash suppressor in accordance with an embodiment of the invention.

Now referring to FIG. 17, there is shown a flash suppressor 25 which in one embodiment is a portion of the muzzle 26 as shown in FIG. 1. In general, other types of muzzle end portions of a firearm can be utilized other than a flash suppressor, but for purposes of explanation, a flash suppressor having the threaded engagement portion 28 will be described as a mount portion for a firearm. In general, FIG. 17 shows only the lock ring 30 in the unlocked orientation. Now referring to FIG. 18, there is shown the lock ring 30 in the locked orientation, where it can be generally appreciated that the muzzle engagement region 47 of the non-concentric engagement surface 45 of the lock ring 30 is in tight virtual engagement with the lock surface region 29.

With the foregoing description in place, there will now be a description of another type of attachment for a firearm, referred to as a blank firing adapter 120 as shown in FIG. 19. In general, the blank firing adapter can be utilized with the locking assembly 22' as described in detail above, or other types of locking assemblies. Further, it should be reiterated that the locking assembly 22 as described in detail above can be utilized with any type of attachment to a firearm, such as a suppressor, blank firing assembly, flash suppressor, or even other types of devices herein not commonly utilized attached to a muzzle, such as an illuminating device, a blunt trauma impact attachment device, or other type of mechanism sought after to be rigidly attached to the end muzzle portion of a firearm, including long guns and pistols.

Figure 20:
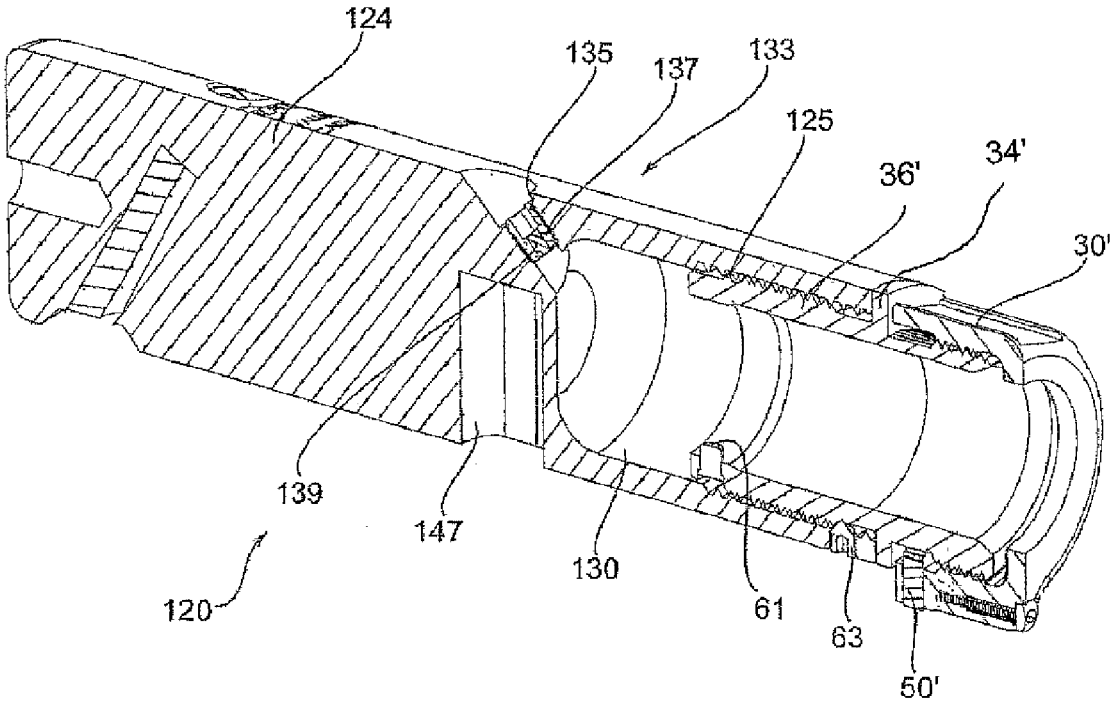
FIG. 20 shows a cross-sectional view taken along the plane in the lateral and vertical directions taken at line 20,21-20,21 of FIG. 19 in accordance with an embodiment of the invention.

Referring now to FIG. 20, there is shown an isometric view in cross-section of the blank firing adapter 120. In general, the blank firing adapter 120 comprises, in one embodiment, similar components of the base mount 34' and the lock ring 30' as described above, which comprises the lock-and-release lever 50. It should be noted that in one embodiment, the base mount 34' can be provided with an extension 61 which can, for example, be a set screw which is operatively configured to be fitted to a surface defining a longitudinally extending slide or slot in the muzzle 26 (see FIG. 24). Further, a lock member 63 can be employed, such as a set screw, to rigidly attach the base mount 34' to the main body 124 (as well as the base mount 34 to the suppressor body 24 as shown in FIGS. 1 and 2).

FIG. 20 generally shows the main body 124 as a unitary structure in one embodiment, where a surface defining an interior chamber 130 is present. In one embodiment, a portion of this chamber in the longitudinally rearward region provides a base attachment 125 which can be a female threaded attachment configured to engage the body attachment region 36' of the base mount 34'. The interior chamber 130 is provided with a bleed port 135 which provides access to the interior chamber and, in one embodiment, is provided with a fitting module, such as threads, to fit a common hexagonal thread pattern to be received by, for example, a hex screw. In general, the insert 137 operates as a bleed for adjusting the amount and volumetric rate of escaping gas therethrough when a blank cartridge is fired to the firearm. The surface defining the bleed orifice 139 can be adjusted and calibrated based on various parameters of the barrel length, the charge of the combusted material in the blank such as the burn rate and total amount of the powder contained therein, and other factors. In general, a plurality of inserts with a properly sized bleed orifice that provides cycling of the semiautomatic weapon without excessive gas blowback can be chosen for operation. At any rate, the bleed insert 137 provides adjustability of the escaping gas exiting the muzzle. Of course in the broader scope, other types of bleed adjustment systems 133 can be implemented, such as a dynamic iris-type system, a recessed screw having a frustoconical end adjusting the toroidal-shaped opening between the screw and an outer housing, a plurality of openings that can be selectively opened to provide access to the interior chamber 130, and a plurality of other mechanisms for adjusting the opening to allow gas to escape. It should be noted that in one embodiment, a bleed port 135 is pointed upwardly and forwardly. Of course this port could be oriented in a number of orientations; however, ejecting the gas upwardly, can aid in preventing a certain amount of muzzle lift.

As further shown in FIG. 20, there is a surface defining an escape port 147. As shown in the view taken along the lateral axis in FIG. 21, it can be appreciated that the escape port 147 is comprised of a longitudinally trailing surface 149 and a longitudinally forward surface 151. Further, the escape port 147 is provided with the barrier 153 which separates the escape port 147 from the interior chamber 130. In normal operation, expanding gas entering the interior chamber 130 will exit through the bleed adjustment system 133 in a manner as described above. However, in the event that the operator of the firearm places a live round into the chamber and initiates the firing sequence, a bullet will travel at a very high velocity (several thousand feet per second with a rifle) down the barrel, out the muzzle and be ejected into the blank firing adapter 120. In one embodiment, the projectile receiving area is operatively configured to have three rounds of a projectile weighing no more than 80 grams traveling at not greater than 3000 feet per second be contained therein when fired from the firearm. The blank firing adapter 120 is not intended to have bullets passing therethrough in normal operation. However, the adapter 120 is designed with safety features to warn the operator of the firearm that a live round is being shot, and further mitigate damage from the live round which has been fired.

In normal operation, the blank firing adapter will produce a sound of approximately 128 dB. Other sound levels (e.g., volumes) may be present in other embodiments. If a live round were to pass into the blank firing adapter 120 the sound would escalate in one embodiment to 154 dB. Other escalated sound levels (e.g., volumes) may be present in other embodiments. In normal operation the volume of sound is attributed to a portion of the gas exiting through the bleed adjustment system 133, as well as other noises created from the operation of the firearm and bleeding gas through other portions, such as the gas return line to operate the bolt of the firearm. The barrier 153 has a thickness to allow the projectile to break therethrough. In one embodiment the barrier has a thickness of 0.100 of an inch. Other thicknesses may be used in other embodiments. The broader range can be 0.030" to 0.700" in one embodiment. Other ranges may be used in other embodiments. The material in one embodiment is aluminum 7075 or other materials having a strength range sufficient to slow projectiles and preferably allow them to eject downwardly. The material may be further configured to have the projectile bullet pierce through the barrier 153 thereby causing sound to be emitted from the escape port 147. In general, the decibel rating of a bullet actually passing through the barrier 153 is much greater (e.g., greater than 10 dB from normal operation) than when a blank is fired to provide clear indication to the shooter that something is wrong. Other decibel ratings may be present in other embodiments.

Figure 21:
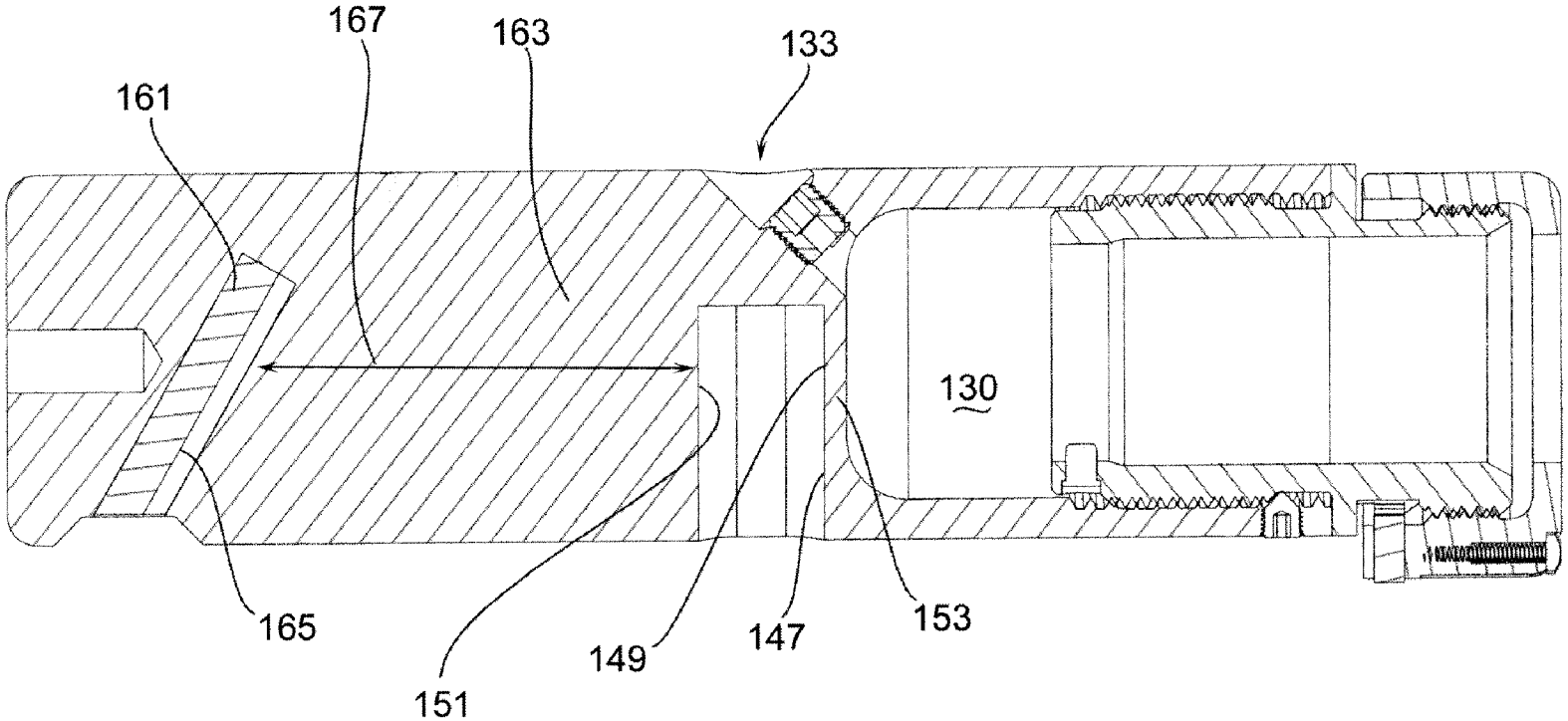
FIG. 21 is a sectional view of the firearm blank firing adapter taken along the lines 20,21-20,21 of FIG. 19 in accordance with an embodiment of the invention.

As further shown in FIG. 21, there is a projectile redirection plate 161 fitted in a longitudinally forward portion of the main body 124. If multiple rounds are fired, the projectile receiving area 163 will generally allow these bullets to pass through the solid material, which is a metallic material such as aluminum in one embodiment but can include other materials such as polymers, steels, composites, and brass. Other methods of capturing bullets could be utilized such as threading a cone shaped cup into the front portion of the main body. The projectile redirection plate 161 in one embodiment has an engagement surface 165 that is pointed forward and downward based in the longitudinally rearward to forward directions so as to impart any bullets impacting thereupon downwardly to prevent impacting anyone down-range from the firearm. The projectile receiving area 163 in one embodiment has an approximate prescribed length indicated by the dimension 167 that is between 1 and 3 inches and has been made at 2" in width, given the strength of the material, such as aluminum 7075, however other lengths and widths may be used in other embodiments. Therefore, one reason that there is a distance of approximately ½"-¾" in one embodiment (e.g., other distances may be used in other embodiments) between the longitudinally trailing surface 149 and the longitudinally forward surface 151 is to provide a sufficiently short distance 167 of the projectile receiving area 163 so the bullets imparted therethrough will be sufficiently slow but will continue to the projectile redirection plate 161. In other words, if the projectile receiving area 163 is too long, the bullets passing therethrough may stack up or otherwise be redirected into lateral and upper locations, which are less desirable areas for the dispersion of bullets. In particular, if the firearm is on full auto mode, several bullets may pass down the muzzle and enter the blank firing adapter 120 before the operator of the firearm has realized that live rounds are being fired.

Figure 22:
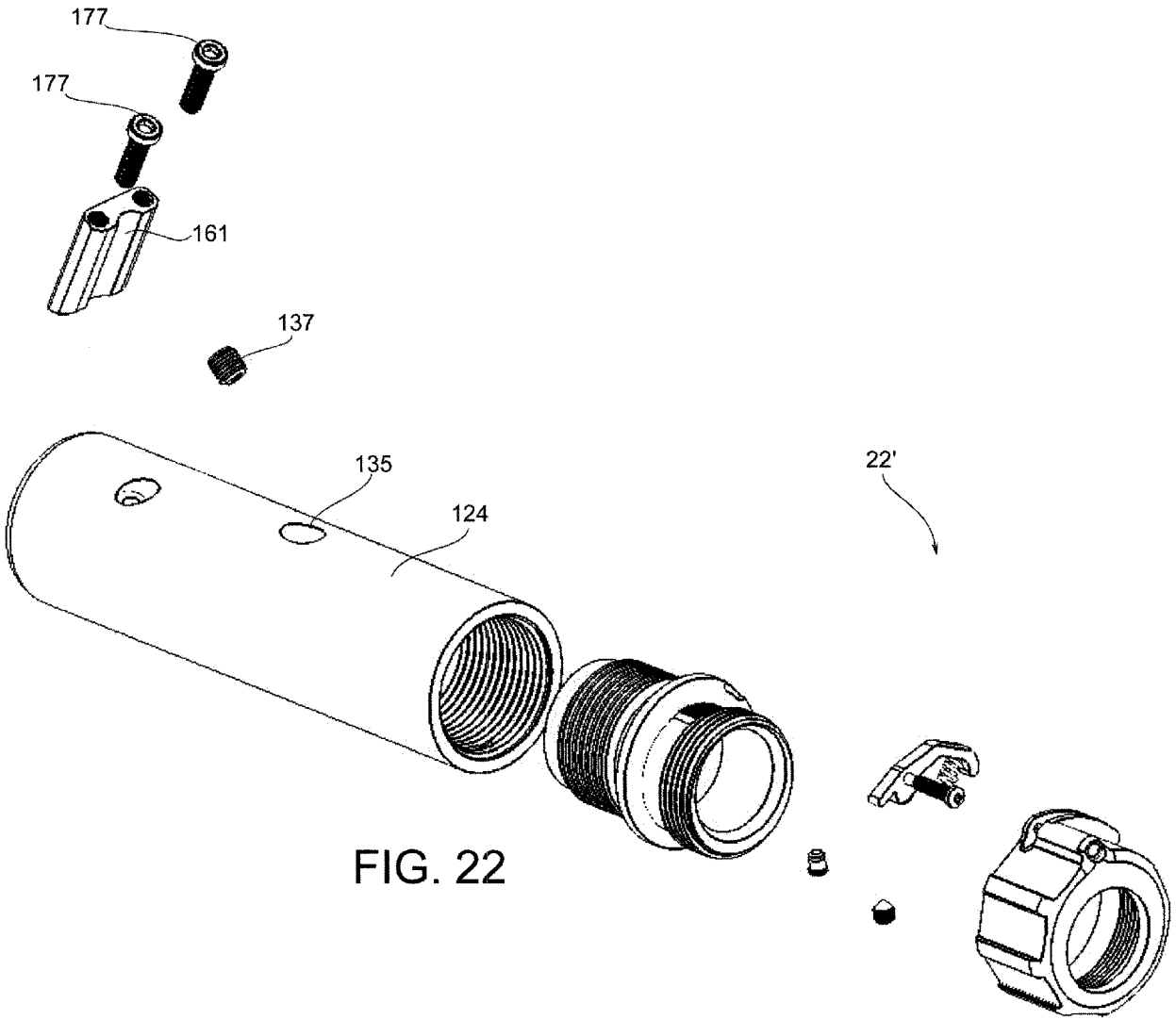
FIG. 22 shows an exploded view of the firearm blank adaptor in accordance with an embodiment of the invention.
Figure 23:
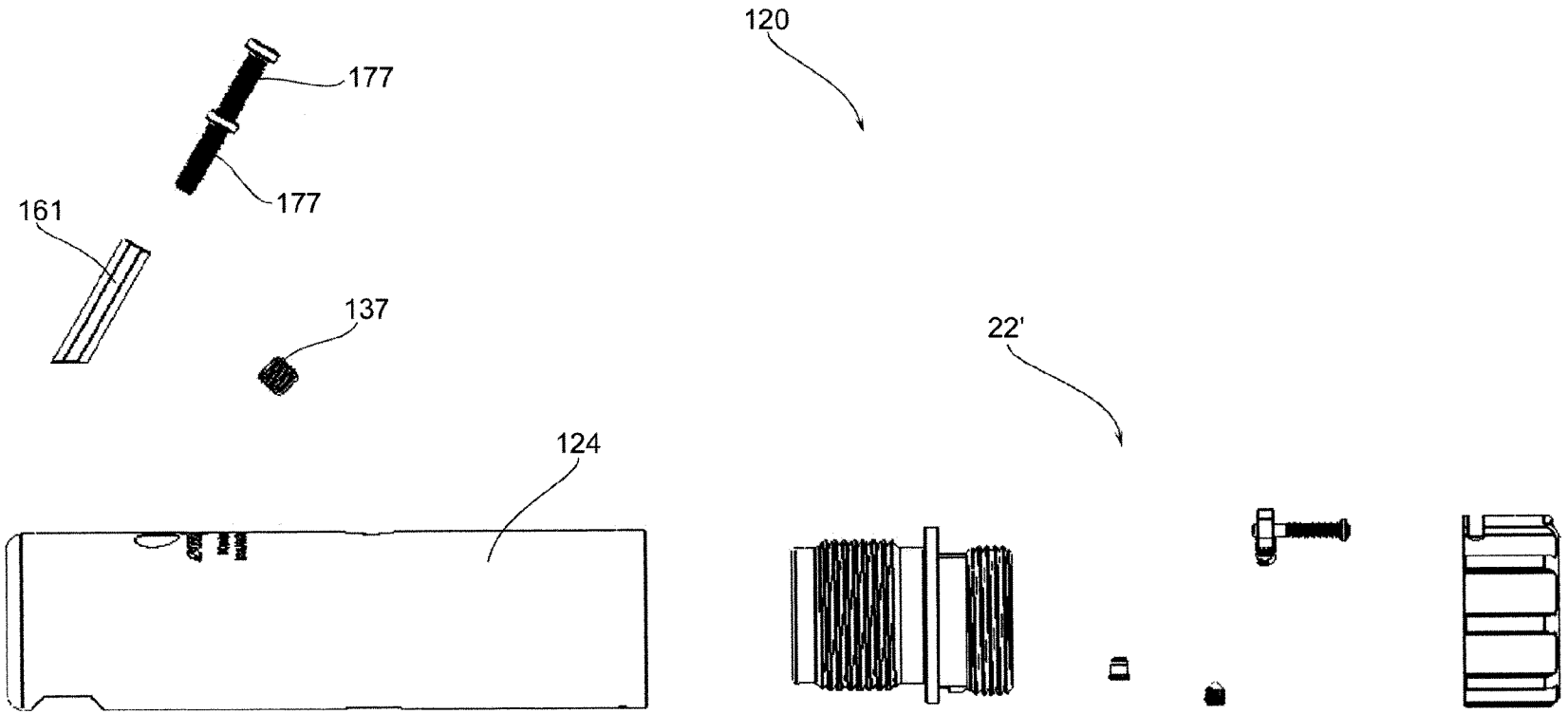
FIG. 23 shows a side profile view of the firearm blank adaptor in accordance with an embodiment of the invention.
Figure 24:
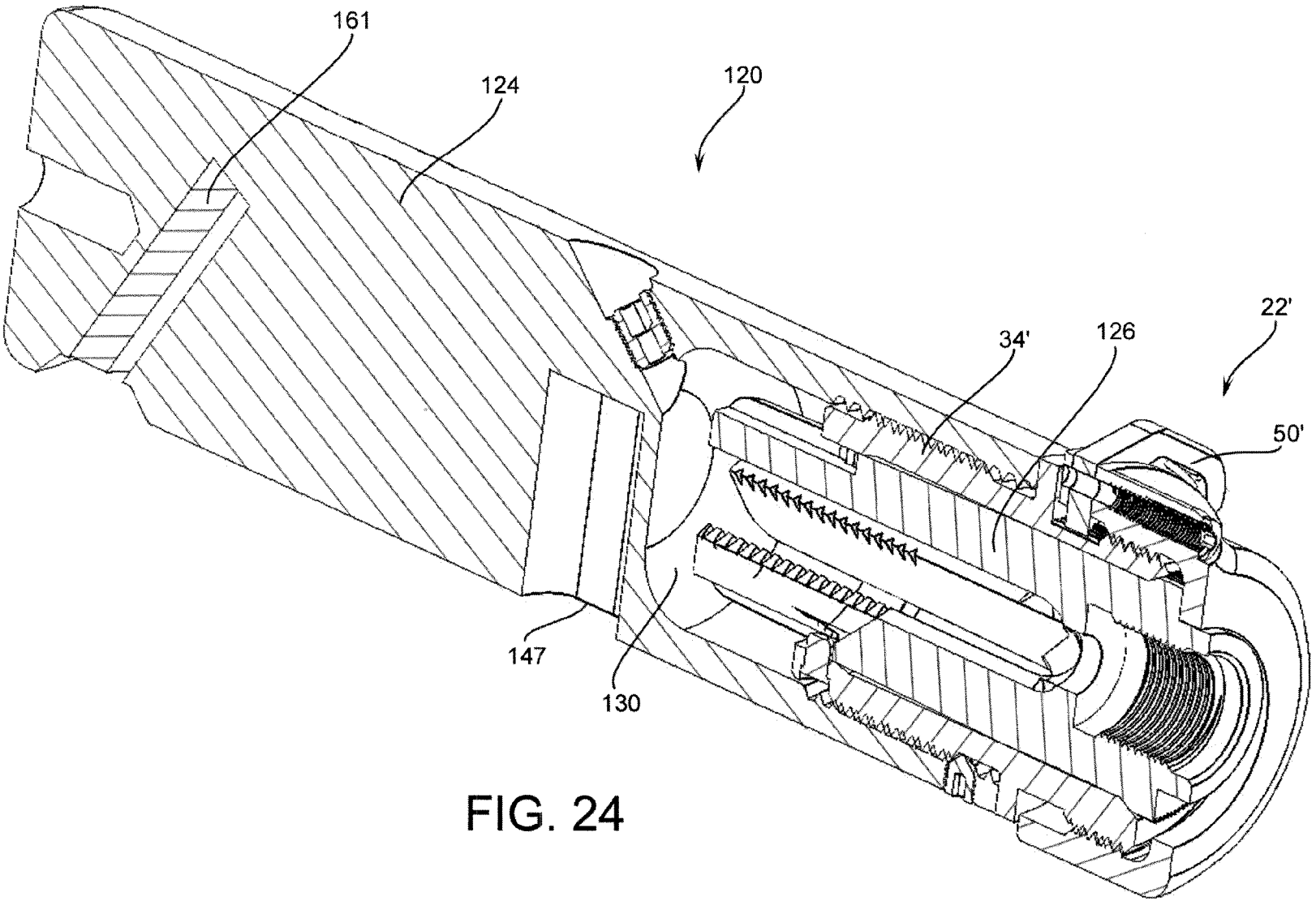
FIG. 24 shows an isometric cross-sectional view of a firearm blank adaptor showing a portion of the muzzle such as a flash suppressor positioned therein a locked orientation in accordance with an embodiment of the invention.

As shown in FIG. 22, there is an exploded view where the main body 124 is shown and the bleed port 135 is provided where the bleed adjustment insert 137 is shown in an exploded embodiment. The projectile redirection plate 161 in one embodiment is of a different harder metal than that of the main body 124. The projectile redirection plate 161 can be fastened in the upper portion by the fasteners 177 with a portion of the main body interposed between the annular heads thereof. Shown in the right-hand portion of FIG. 22 is one embodiment of a locking assembly 22' which is similar in nature as described above. FIG. 23 shows a side view of the exploded blank firing adapter 120. FIG. 24 shows a cross-sectional view where, in this embodiment, the blank firing adapter 120 shows a muzzle 126 inserted therein where one embodiment of the muzzle is an attachment to the forward portion of the barrel where the barrel and the attachment generally form a muzzle region of the firearm. For purpose of explanation, the muzzle 126 which, in one embodiment, is a suppressor is shown unthreaded but could, for example, be threaded to the threaded region 327 of a barrel as shown by example in FIG. 26.

Figure 25:
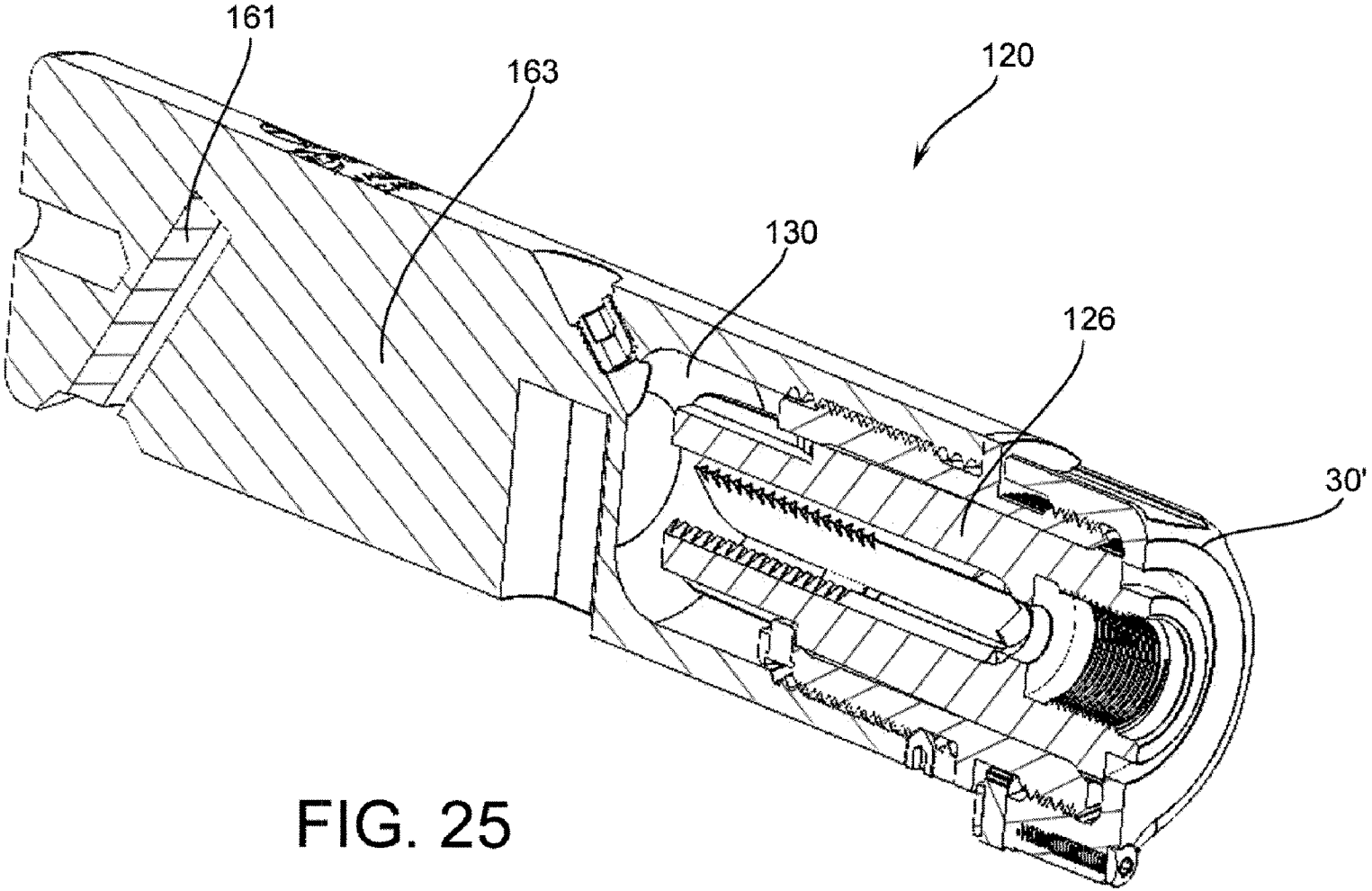
FIG. 25 shows the blank firing adapter with a portion of a muzzle positioned therein with the lock ring in an unlocked orientation in accordance with an embodiment of the invention.

It should be reiterated that the locking assembly 22' can be utilized with any type of attachment mechanism for the muzzle region of a firearm. In one embodiment, this locking assembly 22' is shown with a blank firing adapter. FIG. 25 shows by way of example how the lock ring 30' is in an unlocked orientation whereby the muzzle of the firearm 126 (shown as a flash suppressor) can be withdrawn from the interior chamber 130.

Therefore, the embodiment as described above and generally shown in FIGS. 19-25 is operatively configured to have three rounds be held within the main body at the projectile receiving area 163, and all rounds passing therethrough thereafter will be redirected forwardly and downwardly by way of the projectile redirection plate 161. Other embodiments configured with other numbers of rounds are also contemplated. If the vector distance 167 as shown in FIG. 21 is too long, the rounds can take a more lateral and vertical path and not strike the projection redirection plate. In general, the blank firing adapter 120 can generally have a diameter between 1 and 3 inches in a broader range. In one embodiment, the range is approximately 1.5 inches. Other ranges may be used in other embodiments. Of course the relationship of the diameter to the length of the projectile receiving area 163 can be important for ensuring that the projectiles do not exit laterally but are rather redirected forwardly to be redirected by the projectile redirection plate 161.

Figure 26:
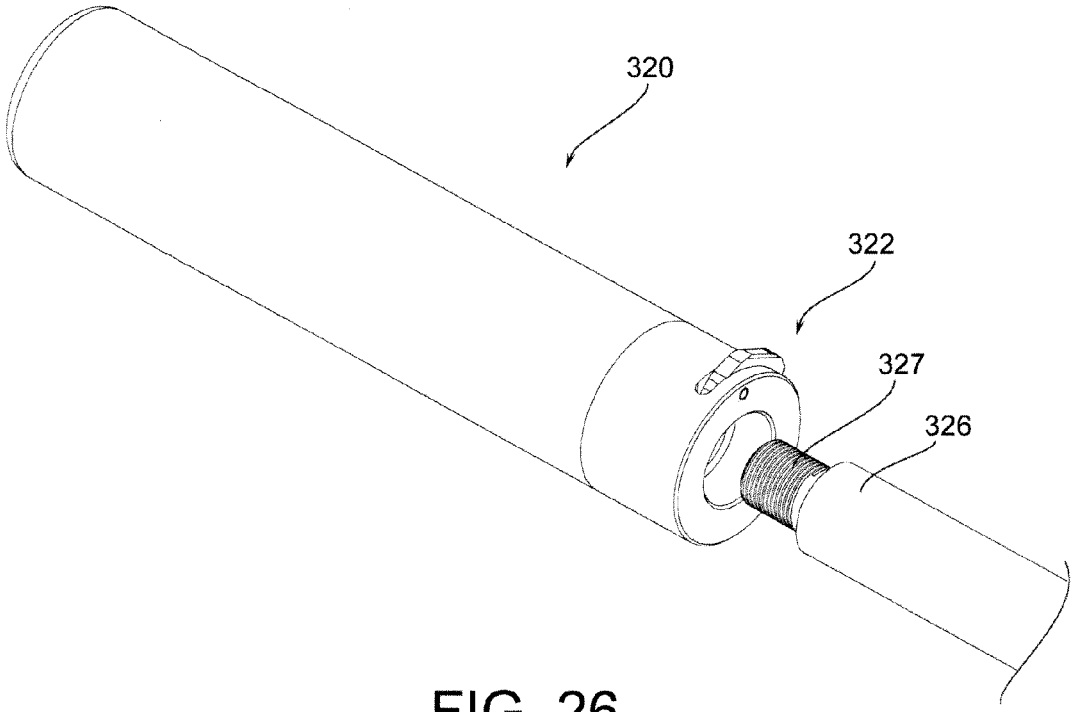
FIG. 26 shows another embodiment where a general firearm attachment is shown positioned adjacent to a muzzle which has a threaded front portion in accordance with an embodiment of the invention.
Figure 27:
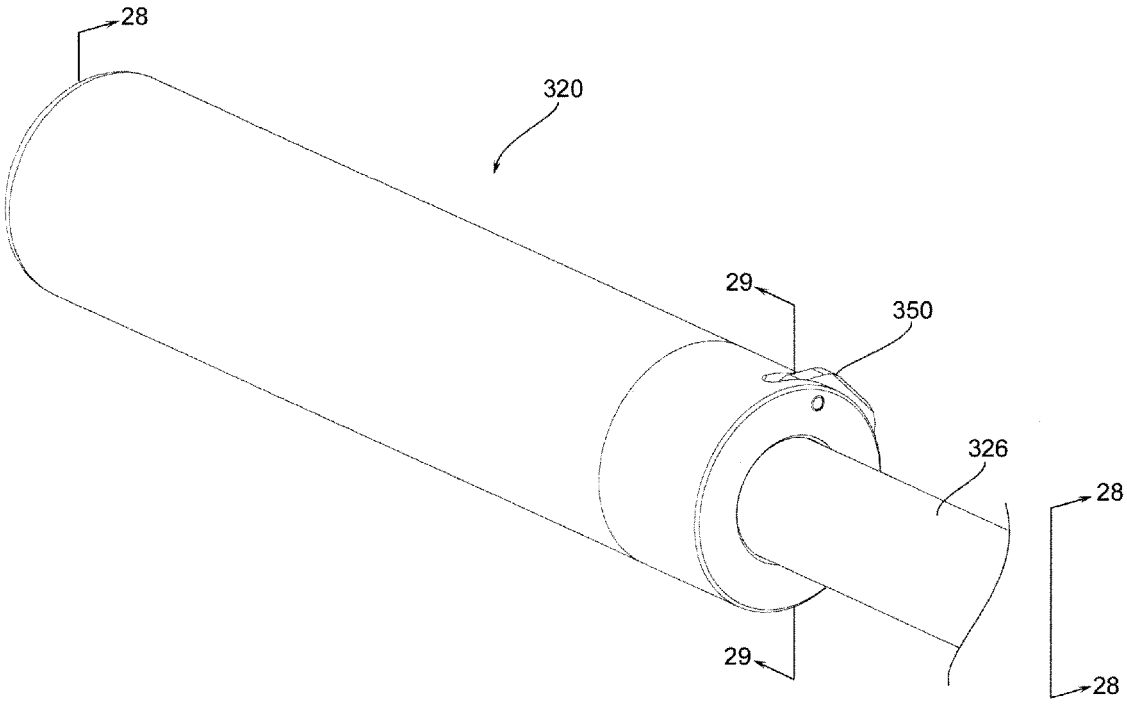
FIG. 27 shows the firearm attachment attached to the muzzle in accordance with an embodiment of the invention.
Figure 28:
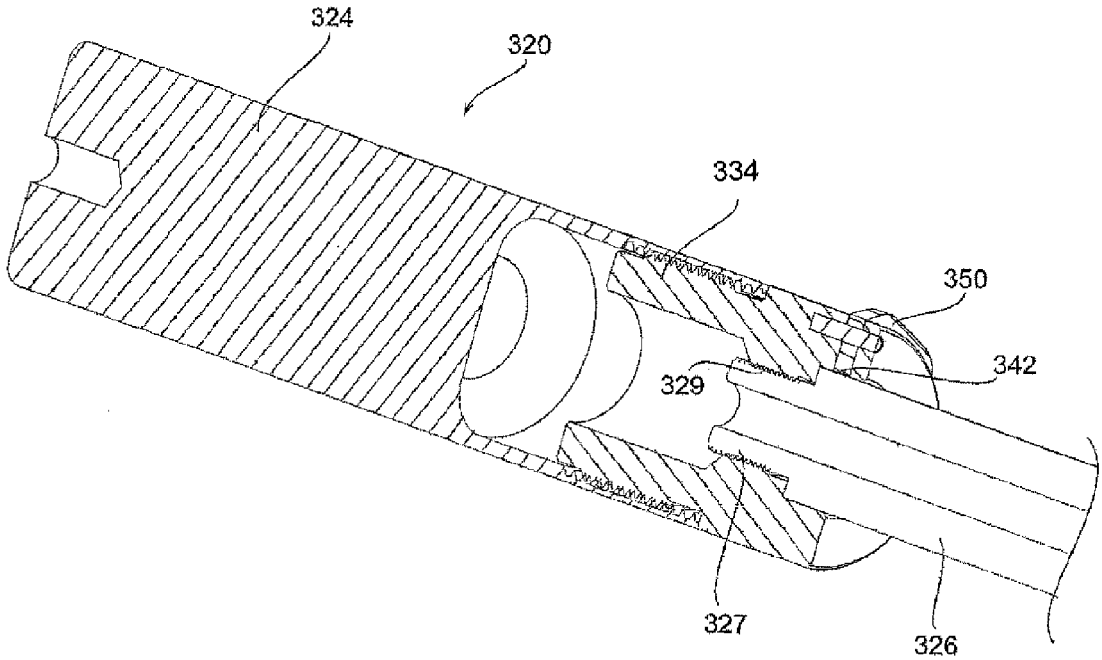
FIG. 28 shows the firearm attachment shown in cross-sectional view taken along line 28-28 of FIG. 27 in accordance with an embodiment of the invention.

Now referring to FIG. 26 there is shown another embodiment of a locking assembly 322. In general, in this embodiment, there is a muzzle 326 which is configured to fit within the suppressor or blank firing adapter, otherwise referred to as the firearm attachment 320. Now referring to FIG. 28 there is shown a cross-sectional view taken at line 28-28 of FIG. 27 which shows the firearm attachment 320 attached to the muzzle 326. It can be appreciated in FIG. 28 that the forward region 327 of the muzzle 326 is provided with a threaded region which in one embodiment is a male threaded region operatively configured to be fitted to the firearm attachment 320 at the muzzle engagement region 329. Of course one traditional method of attaching a suppressor or other embodiments of firearm attachments is to threadedly engage such attachments to a threaded portion of the muzzle. In one embodiment the firearm attachment 320 can be provided with a base mount 334 and a body 324, but there is a plurality of methods of arranging the components or providing a unitary structure for the firearm attachment 20. For purposes of discussion, FIG. 27 shows a hatched view of a variant of a blank firearms adapter, but could also be a suppressor, flash suppressor, or other type of attachment mechanism. It should be noted that the locking release lever 350 which is shown in partial sectional view now directly engages the muzzle and the muzzle provides the locking surface 342.

Figure 29:
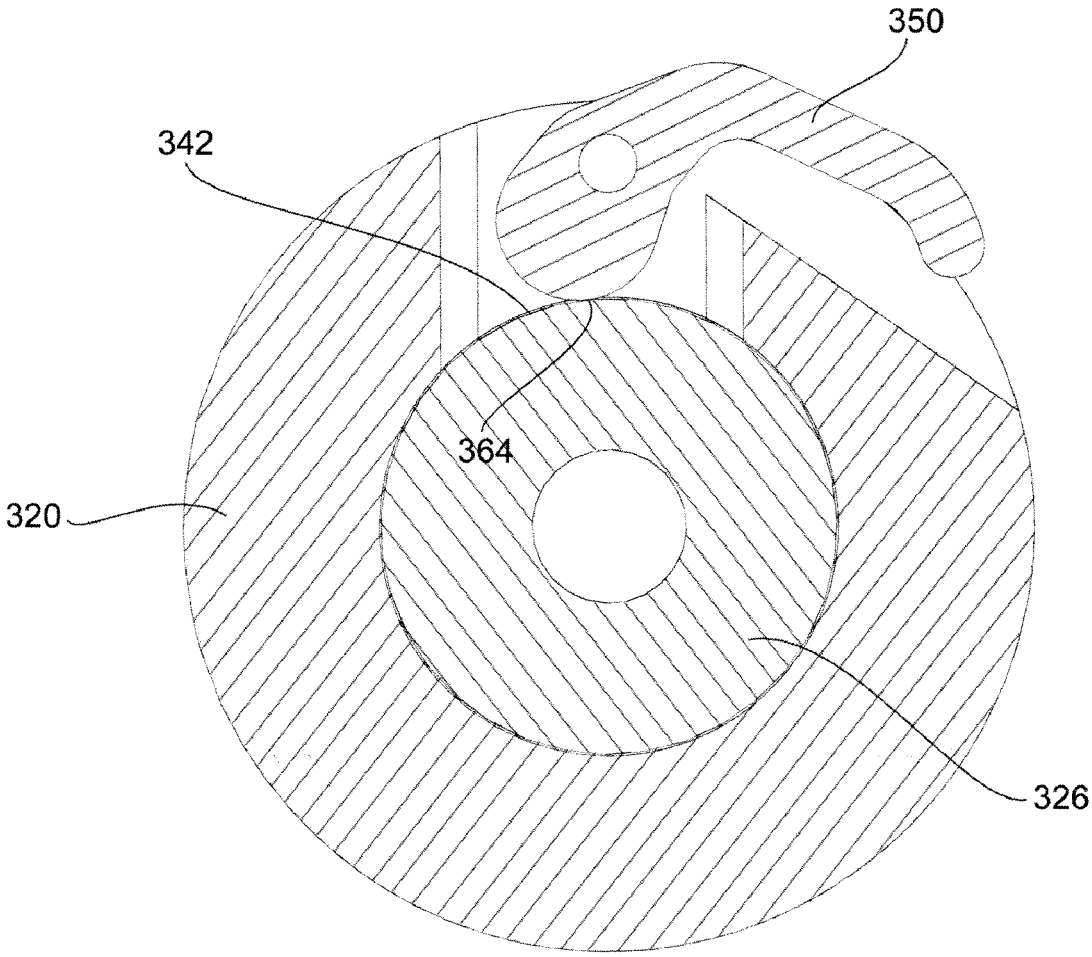
FIG. 29 shows a cross-sectional view taken from line 29-29 of FIG. 27 in accordance with an embodiment of the invention.

Now referring to FIG. 29 there is shown a cross-sectional view taken at line 29-29 of FIG. 27 where the lock-and-release lever 350 can be shown to have a locking engagement surface 364 that directly engages the locking surface 342, which, in this case, is directly upon the muzzle 326. Of course, various other embodiments of the surfaces 364 and 342 can be provided, as described above in the various FIGS. 7A-7G as well as other possible arrangements as defined above.

Figure 30:
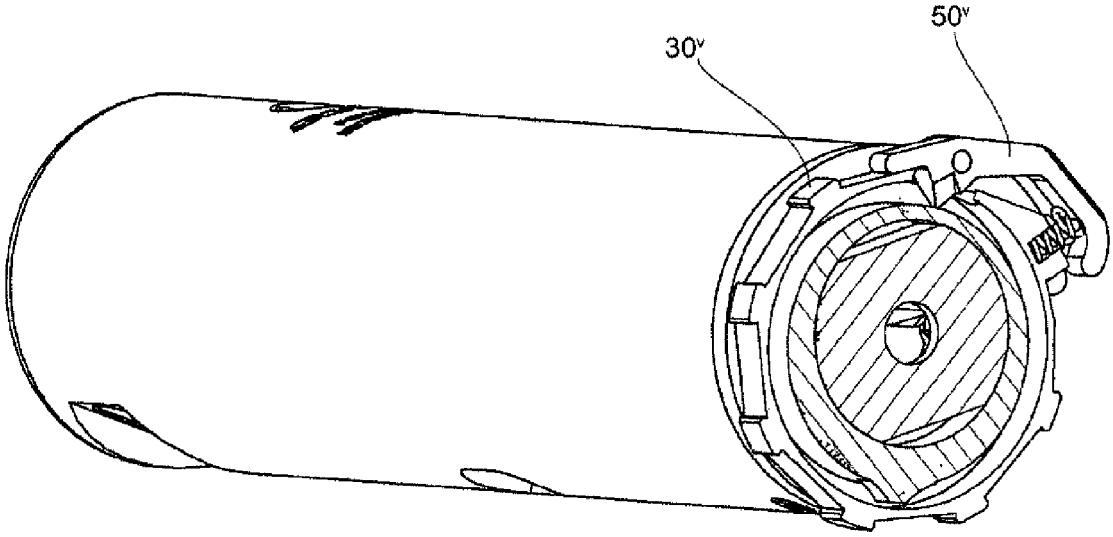
FIG. 30 shows another embodiment of a lock lever in accordance with an embodiment of the invention.
Figure 31:
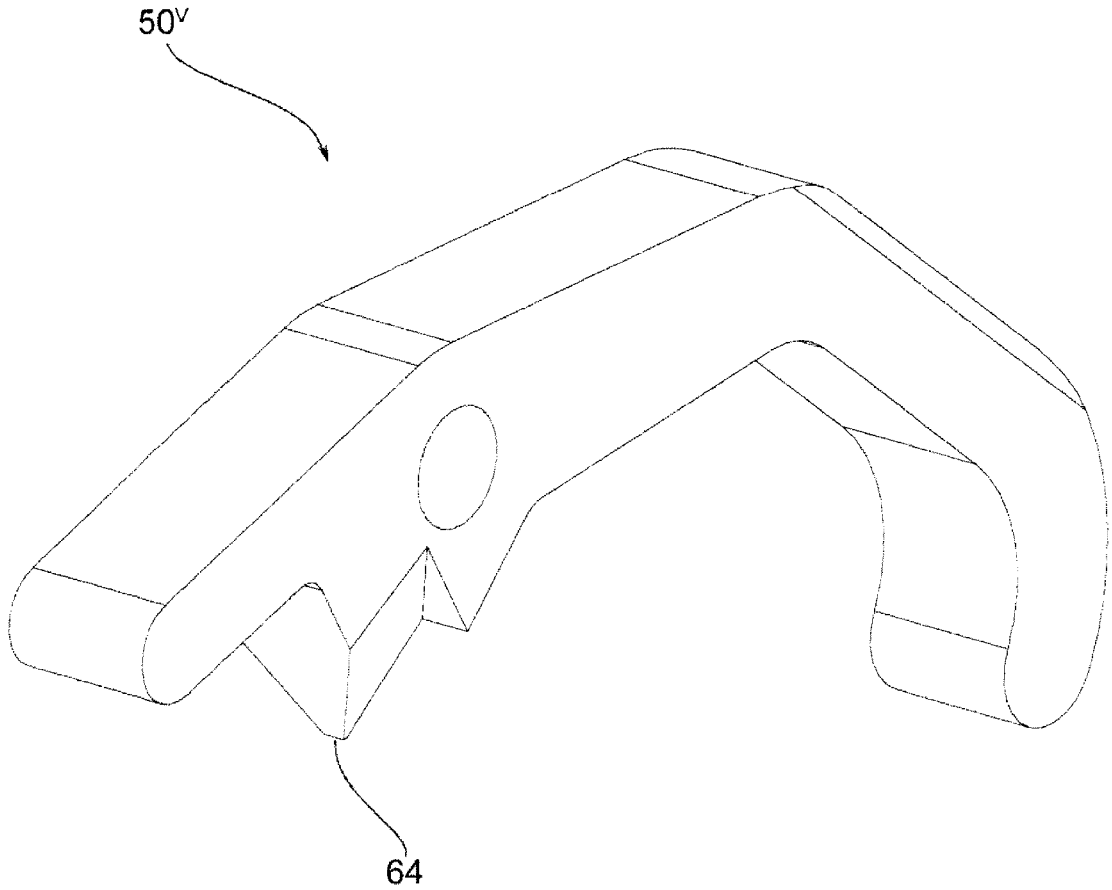
FIG. 31 shows an orthogonal view of the lock lever of FIG. 30 showing a smaller engagement region that tapers in the tangential and longitudinal directions in accordance with an embodiment of the invention.

Now referring to FIG. 30 there is shown yet another embodiment where the lock-and-release lever 50V is attached to the lock ring 30V in a similar manner as described above; however, as shown in FIG. 31, it can be seen that the lock-and-release lever 50V is arranged in such a manner that the lock engagement surface 64 is not only narrowed in the tangential direction but further in the longitudinal direction to find a point of contact. Basically, depending upon the hardness of the materials, a finer point can be utilized.

Where applicable, the various components set forth herein can be combined into composite components and/or separated into sub-components without departing from the spirit of the present invention. Similarly, where applicable, the ordering of various steps described herein can be changed, combined into composite steps, and/or separated into sub-steps to provide features described herein.

Embodiments described above illustrate but do not limit the invention. It should also be understood that numerous modifications and variations are possible in accordance with the principles of the present invention. Accordingly, the scope of the invention is defined only by the following claims.

What is claimed is:

1. A blank firing adapter comprising:

a mount assembly operatively configured to be attached to a muzzle of a firearm;

a main body having an interior chamber;

an escape port positioned longitudinally forward of the interior chamber and not in communication therewith;

a barrier interposed between the escape port and the interior chamber;

a projectile receiving area positioned longitudinally forward of the escape port and configured to slow down a projectile from the muzzle there through; and a projectile redirection plate disposed forward of the escape port and positioned at least partially on a central axis of the muzzle.

2. The blank firing adapter of claim 1, further comprising a bleed port providing an opening in communication with the interior chamber so as to allow expanding gas from the muzzle of the firearm to pass therethrough.

3. The blank firing adapter of claim 2, where the bleed port ejects gas forwardly and upwardly.

4. The blank firing adapter of claim 1, where the barrier between the escape port and the interior chamber is less than approximately one-half of an inch.

5. An attachment to a firearm provided to allow the firearm to fire blanks where the attachment increases pressure within a barrel of the firearm to operate the action of the firearm, the attachment comprising:

a main body having an interior chamber in communication with the barrel of the firearm and operatively configured to receive high-pressure gas therein;

an escape port having at least a portion thereof positioned on a central axis of the barrel;

a barrier disposed between the escape port and the interior chamber, the barrier being sufficiently thin to allow a bullet projectile from the barrel to pass through the barrier; and a projectile redirection plate disposed forward of the escape port and positioned at least partially on the central axis of the barrel.

6. The attachment of claim 5, where the attachment further comprises a bleed port in fluid connection with the interior chamber that allows expanding gases to exit the interior chamber whereby an increase in sound through the escape port is produced with respect to the degree of sound though the bleed port when a blank round is fired in the firearm.

7. The attachment of claim 5, where the sound emitted when a live round passes through the barrier is at least approximately 10 dB greater than the sound emitted when a blank is fired.

8. The attachment of claim 5, where the barrier is less than approximately 0.2 inches.

9. The attachment of claim 5, further comprising a projectile receiving area between the escape port and the projectile redirection plate and having a length of at least approximately 1 inch.

10. The attachment of claim 9, where the projectile receiving area is comprised of aluminum.

11. The attachment of claim 9, where the projectile receiving area is operatively configured to contain three rounds of a projectile weighing no more than approximately 80 grains traveling at not greater than approximately 3000 feet per second.

12. A method of indicating to a user of a firearm that live ammunition is being fired, the method comprising:

attaching a blank firing adapter to a muzzle of the firearm;

providing an interior chamber that is in communication with the muzzle of the firearm and providing an opening for expanding gas to escape from the interior chamber; and providing a port that is separated from the interior chamber by a barrier of sufficiently low strength so as to allow a projectile designed for use with the firearm to pass through the barrier whereby when such a projectile passes through the barrier the expanding gas escaping through the port create a sound of at least approximately 10 dB greater than when a blank is fired.

13. The method of claim 12, where a projectile receiving area is provided at a longitudinally forward portion of the port so as to stop bullets from exiting on a trajectory substantially aligned with the muzzle of the firearm.

* * * * *

UNITED STATES PATENT AND TRADEMARK OFFICE

CERTIFICATE OF CORRECTION

PATENT NO. : 8,201,487 B2
APPLICATION NO. : 12/774500
DATED : June 19, 2012
INVENTOR(S) : Barry W. Dueck and Karl Honigmann It is certified that error appears in the above-identified patent and that said Letters Patent is hereby corrected as shown below:

In column 8, line 43, change "111e" to -- 111c --.

Signed and Sealed this
Fourth Day of December, 2012

David J. Kappos

David J. Kappos
*Director of the United States Patent and Trademark Office*